US008088459B2

(12) United States Patent
Liao et al.

(10) Patent No.: US 8,088,459 B2
(45) Date of Patent: Jan. 3, 2012

(54) AIR ENCLOSURE WITH INDEPENDENT DOUBLE LAYER AIR CHAMBERS

(75) Inventors: Chian Hua Liao, Sindian (TW); Yao Sin Liao, Sindian (TW); Yao Chuan Liao, Sindian (TW)

(73) Assignee: Yao Sin Liao, Sindian (TW)

( * ) Notice: Subject to any disclaimer, the term of this patent is extended or adjusted under 35 U.S.C. 154(b) by 1022 days.

(21) Appl. No.: 11/753,415

(22) Filed: May 24, 2007

(65) Prior Publication Data

US 2008/0118680 A1 May 22, 2008

(30) Foreign Application Priority Data

Nov. 17, 2006 (TW) ..... 95142730 A

(51) Int. Cl.
*B65D 81/03* (2006.01)
*B65D 85/00* (2006.01)

(52) U.S. Cl. ..... 428/35.7; 206/522; 229/87.02

(58) Field of Classification Search ..... 206/522; 229/87.02; 428/34.1
See application file for complete search history.

(56) References Cited

U.S. PATENT DOCUMENTS 3,282,412 A * 11/1966 Corella et al. ..... 206/221
4,708,167 A * 11/1987 Koyanagi ..... 137/512.15
4,850,912 A 7/1989 Koyanagi
4,872,558 A 10/1989 Pharo
5,427,830 A * 6/1995 Pharo ..... 428/35.2
5,489,464 A * 2/1996 Bjorck ..... 428/178
5,727,270 A * 3/1998 Cope et al. ..... 5/710
6,415,467 B1 * 7/2002 Bretvin ..... 5/710
6,513,974 B2 * 2/2003 Malone et al. ..... 383/3
6,629,777 B2 * 10/2003 Tanaka et al. ..... 383/3
6,775,868 B1 * 8/2004 Mileti et al. ..... 5/710
7,066,331 B2 * 6/2006 Koyanagi et al. ..... 206/522
7,128,211 B2 * 10/2006 Nishi et al. ..... 206/522
7,174,589 B2 * 2/2007 Mileti ..... 5/710
7,201,273 B2 * 4/2007 Chen et al. ..... 206/522
7,228,969 B2 * 6/2007 Nakano ..... 206/522
7,311,204 B2 * 12/2007 Nishi et al. ..... 206/522

(Continued)

FOREIGN PATENT DOCUMENTS

DE 29519421 U1 2/1996

(Continued)

*Primary Examiner* — Michele L Jacobson
(74) *Attorney, Agent, or Firm* — Rabin & Berdo, P.C.

(57) ABSTRACT

An air enclosure with independent double layer air chambers is constituted by disposing a middle film between a first outer film and a second outer film which are folded together, in which the length of the middle film is shorter than the first outer film and the second outer film, and the lower sides of the three parties are lined up with one another to allow an air filling passageway to be formed on one common end of the first outer film and the second outer film by means of hot sealing and in the meantime, a first air inlet and a plurality of first air chambers to be formed by adhering the first outer film to the middle film and a second air inlet and a plurality second air chambers to be formed by adhering the middle film to the second outer film. When the air in the air filling passageway is filled into the first air chamber to cause it to be expanded via the first air inlet and in the meantime, filled into the second air chamber to cause it to be expanded via the second air inlet, and when any one of the first air chamber and the second air chamber is broken, the another can provide the cushioning protection effect.

12 Claims, 18 Drawing Sheets

U.S. PATENT DOCUMENTS

| | | | | |
|---|---|---|---|---|
| 7,410,057 | B2 * | 8/2008 | Yoshifusa | 206/522 |
| 7,464,520 | B2 * | 12/2008 | Nishi et al. | 53/472 |
| 7,568,508 | B2 * | 8/2009 | Liao et al. | 141/114 |
| 7,665,609 | B2 * | 2/2010 | Liao et al. | 206/522 |
| 7,681,379 | B2 * | 3/2010 | Nishi et al. | 53/474 |
| 7,681,734 | B2 * | 3/2010 | Liao et al. | 206/522 |
| 7,694,820 | B2 * | 4/2010 | Liao et al. | 206/522 |
| 7,695,786 | B2 * | 4/2010 | Liao et al. | 428/34.1 |
| 7,770,731 | B2 * | 8/2010 | Jian | 206/522 |
| 2002/0185403 | A1 * | 12/2002 | Russo | 206/522 |
| 2003/0021923 | A1 * | 1/2003 | Russo | 428/35.2 |
| 2004/0265523 | A1 * | 12/2004 | Koyanagi et al. | 428/35.7 |
| 2005/0103676 | A1 * | 5/2005 | Lee | 206/522 |
| 2005/0178446 | A1 * | 8/2005 | Chen | 137/512.15 |
| 2005/0189257 | A1 * | 9/2005 | Chen et al. | 206/522 |
| 2005/0263205 | A1 * | 12/2005 | Koyanagi et al. | 141/10 |
| 2006/0131202 | A1 * | 6/2006 | Kramer | 206/522 |
| 2006/0191815 | A1 * | 8/2006 | Nishi et al. | 206/522 |
| 2006/0191816 | A1 * | 8/2006 | Nishi et al. | 206/522 |
| 2006/0191817 | A1 * | 8/2006 | Nishi et al. | 206/522 |
| 2007/0175522 | A1 * | 8/2007 | Chen et al. | 137/512.1 |
| 2007/0267094 | A1 * | 11/2007 | Liao et al. | 141/114 |
| 2008/0060718 | A1 * | 3/2008 | Liao et al. | 141/114 |
| 2008/0095474 | A1 * | 4/2008 | Liao et al. | 383/3 |
| 2008/0121307 | A1 * | 5/2008 | Liao et al. | 141/198 |
| 2008/0156420 | A1 * | 7/2008 | Liao et al. | 156/182 |
| 2009/0297068 | A1 * | 12/2009 | Liao et al. | 383/3 |

FOREIGN PATENT DOCUMENTS

| | | | |
|---|---|---|---|
| DE | 202004006032 | U1 | 9/2004 |
| EP | 0719714 | A1 | 7/1996 |
| JP | 1994-067370 | U | 9/1994 |
| JP | 1996-001398 | U | 9/1996 |
| JP | 09095359 | A | 4/1997 |
| JP | 10-329869 | A | 12/1998 |
| JP | 2001-524053 | A | 11/2001 |
| JP | 2001-348067 | A | 12/2001 |
| KR | 200390052 | Y1 | 7/2005 |
| TW | M263325 | | 5/2005 |
| TW | M292564 | | 6/2006 |
| WO | 2005003016 | A2 | 1/2005 |

* cited by examiner

AIR ENCLOSURE WITH INDEPENDENT DOUBLE LAYER AIR CHAMBERS

CROSS-REFERENCES TO RELATED APPLICATIONS

This non-provisional application claims priority under 35 U.S.C. § 119(a) on Patent Application No. 095142730 filed in Taiwan, R.O.C. on 2006 Nov. 17, the entire contents of which are hereby incorporated by reference.

FIELD OF THE INVENTION

The present invention relates to an air enclosure, and more particularly to an air enclosure with independent double layer air chambers.

BACKGROUND

A conventional way for packing an article with a cushioning agent mostly is wrapping around the article with a plastic sheet on which a plurality of small raised air bags are projected to attain to the shock-absorbed cushioning functions. But the shock absorption capability of the small air bags is limited such that the cushioning and the shock absorption effects to a larger shock or impulse cannot be attained. Therefore, an air packing bag is developed to take as a wrapping cushioning means However, the air bag made from polyethylene (PE) is easy to be pierced through by a sharp acute angle of a packed article or an adjoining angle of hardware; once a small broken hole appears on the air packing bag, fluid in the air packing bag is then leaked out. For example, in The U.S. Pat. No. 4,850,912 entitled as "Container for sealingly containing a fluid", The U.S. Pat. No. 5,261,466 entitled as "Process for continuously filling fluid into a plurality of closed bags", each air cylinder of the air packing bag disclosed by them is disposed with an independent check valve, it is limited to the air cylinder on which the broken hole is yielded leaks air, and is not to cause other unbroken air cylinders to leak air when parts of the air cylinders are broken. Although such structure does not cause the whole air to be leaked due to the damage of the parts of the air cylinders, but the broken air cylinders will lose the cushioning protection effect; it is easy to cause a packed article to be damaged or scratched.

Therefore, for not only improving a structure of an air packing bag, but also solving the problem that the parts of the air cylinders are broken to cause the air to be leaked out and hence, the air packing bag loses the cushioning protection function, the present invention is proposed.

SUMMARY OF THE INVENTION

For improving the deficits mentioned above, the present invention proposes an air enclosure, with independent double layer air chambers, it comprises a first outer film, a second outer film, a middle film, an air filling passageway, a plurality of first air chambers, at least one first air inlet, a plurality of second air chambers and at least one second air inlet, in which the second outer film is stacked together with the first outer film; the middle film is disposed between the first and the second outer films, the length thereof is shorter than the first outer and the second outer films and one side of the middle film is lined up with one side of the first outer film and one side of the second outer film; the air filling passageway is an air passable space formed by adhering the first outer film and the second outer film by means of hot sealing; each first air chamber is positioned at one side of the air filling passageway and is an air storable space formed by adhering the first outer film and the middle film by means of hot sealing; the first air inlet is formed between the first outer film and the middle film and used for communicating the air filling passageway with the first air chamber; each second air chamber is positioned at one side of the air filling passageway and is an air storable space formed by adhering the second outer film and the middle film by means of hot sealing; the second air inlet is formed between the second outer film and the middle film and used for communicating the air filling passageway with the second air chamber.

The present invention proposes another air enclosure with independent double layer air chambers, it comprises a first outer film, a second outer film, a middle film, at least one first inner film, at least one second inner film, an air filling passageway, a plurality of first air chambers, at least one first air inlet, a plurality of second air chambers and at least one second air inlet, in which the second outer film is stacked together with the first outer film; the middle film is disposed between the first and the second outer films, the length thereof is shorter than the first outer and the second outer films and one side of the middle film is lined up with one side of the first outer film and one side of the second outer film; the first inner film is positioned between the first outer film and the middle film; the second inner film is positioned between the middle and the second outer films; the air filling passageway is an air passable space formed by adhering the first inner film and the second inner film by means of hot sealing; each first air chamber is positioned at one side of the air filling passageway and is an air storable space formed by adhering the first outer film and the middle film by means of hot sealing; the first air inlet is formed between the first outer film and the middle film and used for communicating the air filling passageway with the first air chamber; each second air chamber is positioned at one side of the air filling passageway and is an air storable space formed by adhering the second outer film and the middle film by means of hot sealing; the second air inlet is formed between the second outer film and the middle film and used for communicating the air filling passageway with the second air chamber.

According to the structure mentioned above, the first air chamber and the second air chamber are opposite to each other and the volume of the first air chamber is the same as the volume of the second air chamber.

Besides, a cutting zone is disposed on the air filling passageway according to the present invention, cutting along the cut area to cause the first air chamber and the second air chamber to be separated to enable the output of the air enclosures to be doubled.

After air is filled in the air filling passageway, the air in the air filling passageway is filled into the first air chamber via the first air inlet to cause the first air chamber to be expanded an in the meantime, filled into the second air chamber via the second air inlet to cause the second air chamber to be expanded, thereby, not only the air filling speed of both the first and the second air chambers can be faster but also when one of the first and the second air chambers is broken, the another can be allowed to provide the cushioning protection to maintain the shock absorbing cushioning capability.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
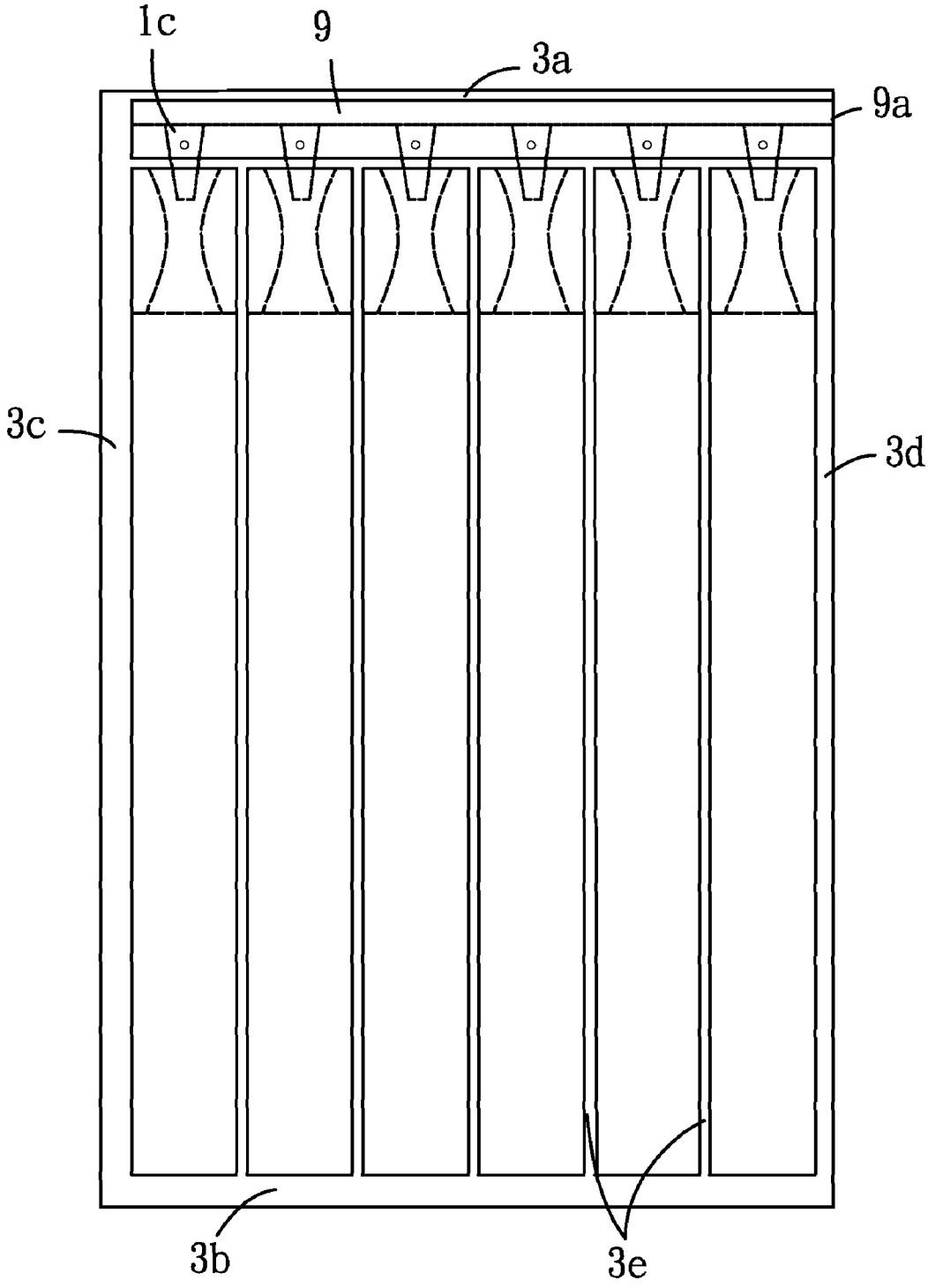
FIG. 1 is a plane view, showing an air enclosure with independent double layer air chambers before air filling of a first preferred embodiment according to the present invention.
Figure 2:
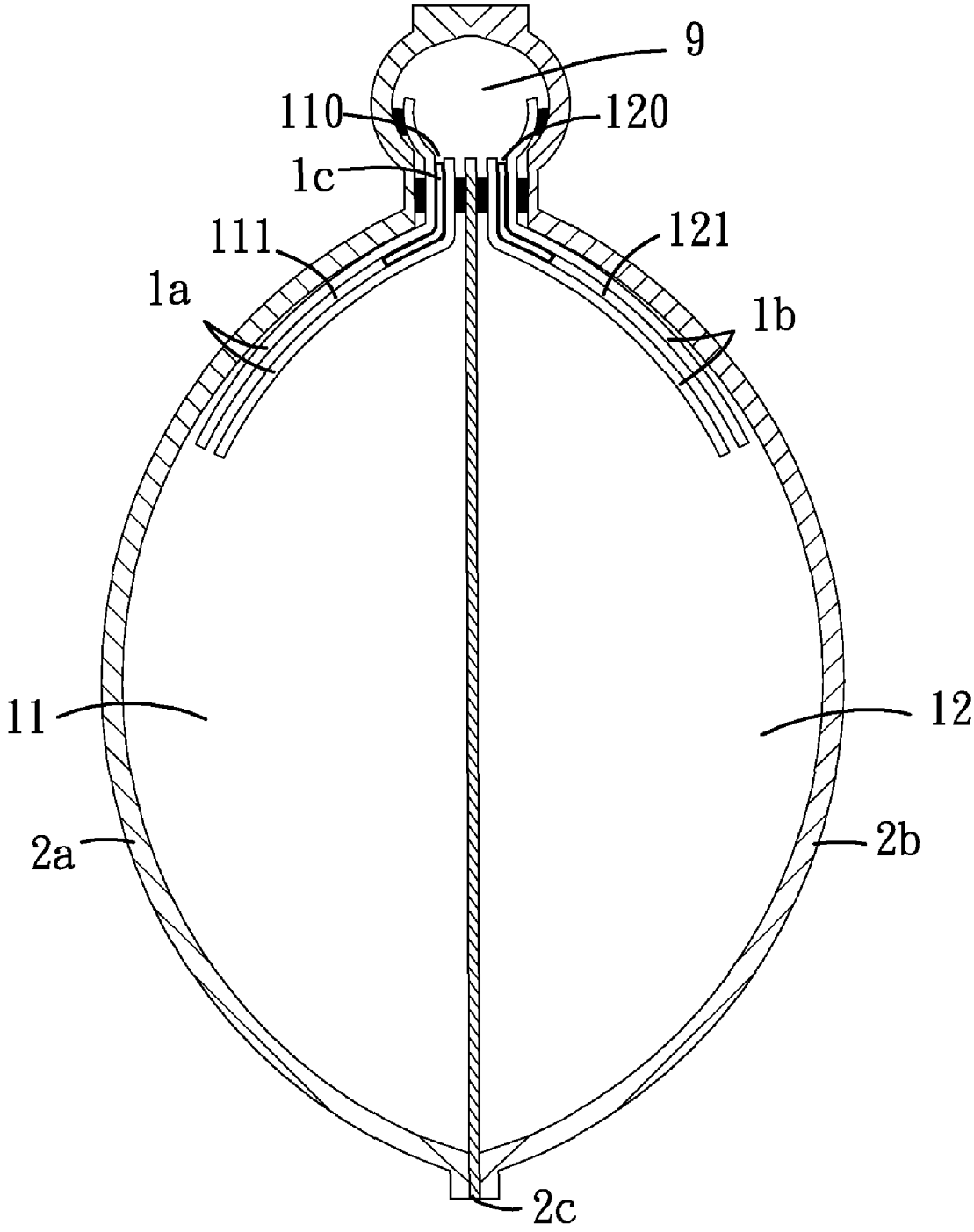
FIG. 2 is a cross sectional view, showing an air enclosure with independent double layer air chambers after air filling of a first preferred embodiment according to the present invention.
Figure 3:
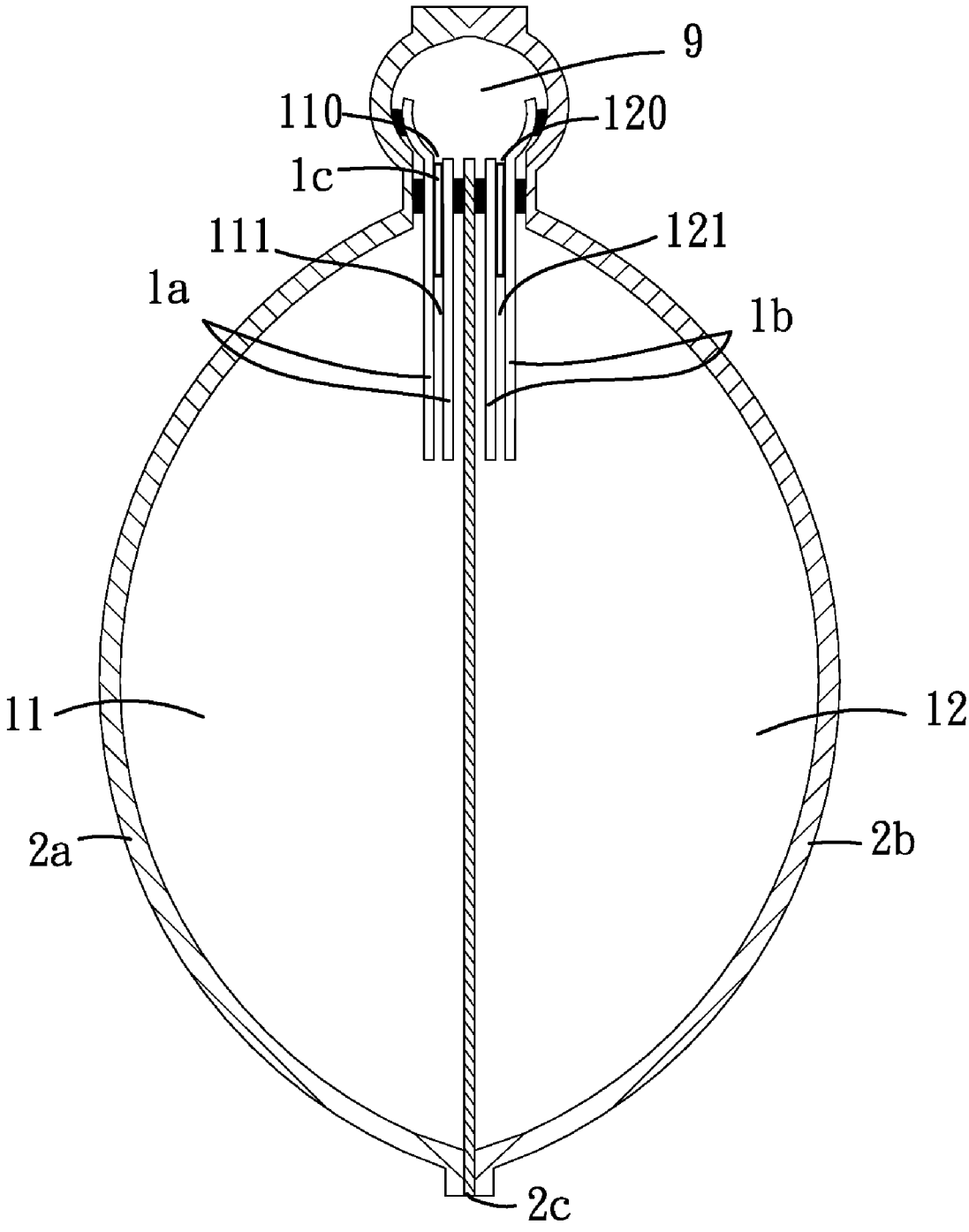
FIG. 3 is a cross sectional view, showing an air enclosure with independent double layer air chambers after air filling of a first preferred embodiment according to the present invention.

Please refer to FIGS. 1 to 3. FIG. 1 is a plane view, showing an air enclosure with independent double layer air chambers before air filling of a first preferred embodiment according to the present invention. FIG. 2 is a cross sectional view, showing an air enclosure with independent double layer air chambers after air filling of a first preferred embodiment according to the present invention. FIG. 3 is a cross sectional view, showing an air enclosure with independent double layer air chambers after air filling of a first preferred embodiment according to the present invention.

An air enclosure with independent double layer air chambers comprises a first outer film 2*a*, second outer film 2*b*, middle film 2*c*, first inner film 1*a*, second inner film 1*b*, air filling passageway 9, first air chamber 11 and second air chamber 12.

The first and the second outer films 2*a* and 2*b* are folded together vertically.

The middle film 2*c* is disposed between the first outer film 2*a* and the second outer film 2*b*, the length of the middle film 2*c* is shorter than the first outer film 2*a* and the second outer film 2*b* and the lower side of the middle film 2*c* is lined up with the lower sides of the first outer film 2*a* and the second outer film 2*b*.

Two first inner films 1*a* are positioned between the first outer film 2*a* and the middle film 2*c*, and the upper sides of the first inner films 1*a* are lined up with the upper side of the middle film 2*c*.

Two second inner films 1*b* are positioned between the middle film 2*c* and the second outer film 2*b*, and the upper sides of the second inner films 1*b* are lined up with the upper side of the middle film 2*c*

Hot sealing is processed along hot sealing lines 3*a*, 3*b*, 3*c* and 3*d* so as to adhere the first outer film 2*a*, the second outer film 2*b*, the middle film 2*c*, the two first inner films 1*a* and the two second inner films 1*b* to cause the air-passable air filling passageway 9 to be formed between the first outer film 2*a* and the second outer film 2*b* to allow the air filling passageway 9 to be positioned on one common end of the first outer film 2*a* and the second outer film 2*b* in which the air filling passageway 9 comprises an air filling entrance 9*a* opened to outside air. Furthermore, the hot sealing mentioned above can be hot mold pressing.

The air storable first air chamber 11 is caused to form between the first outer film 2*a* and the middle film 2*c* and the air storable second air chamber 12 is formed between the middle film 2*c* and the second outer film 2*b* after hot sealing is processed, in which the first air chamber 11 is disposed oppositely to the second air chamber 12 and the volume of the first air chamber 11 is the same as the volume of the second air chamber 12.

A heat resistant material 1*c* is spread sequentially and separately between the two first inner films 1*a*, e.g. heat resistant rubber or ink is printed. The two first inner films 1*a* are still not adhered to each other to form an air inlet 110 and a first air passageway 111 connected to the first air inlet 110 used for communicating the air filling passageway 9 and the first air chamber after hot sealing is processed. Here, the first air passageway 111 is a hot-sealing curve type and the width of one end of the first air passageway 111 connected to the first air inlet 110 is larger than the width of another end thereof, and the air pressure in a curved portion of the air passageway 111 is larger than the air pressure in two sides thereof to allow the air in the first air inlet 110 to enter easily and escape out uneasily. The curved portion of the first air passageway 111 is thrust tightly to attain to the air locking effect when the inner air pressure in the first air chamber increases. Furthermore, the first air passageway 111 can also be a multiple dots type, double curve type or straight line type air flowing route. Besides, a second air inlet 120 and a second air passageway 121 having the same structures are formed between the two second inner films 1*b* and used for communicating the air filling passageway 9 with the second air chamber 12.

The air entering the air filling entrance 9*a* expands the air filling passageway 9 to cause the two first inner films 1*a* to be pulled outward to open each first air inlet 110 and in the meantime, cause the two inner films 1*b* to be pulled outward to open each second air inlet 120, thereby the air in the air filling passageway 9 can be used to fill each first air chamber 11 and each second air chamber 12 with air to allow each first air chamber 11 and each second air chamber 12 to be filled with air and expanded. Thus, the inner air pressure of the first air chamber 11 presses the two first inner films 1*a* to attach closely onto the first outer film 2*a* or the middle film 2*c* to cover the first air passageway 111 and hence, seal the first air chamber 11. Similarly, the inner air pressure of the second air chamber 12 presses the two second inner films 1*b* to attach closely onto the middle film 2*c* or the second outer film 2*b* to cover the second air passageway 121 and hence, seal the second air chamber 12. Whereby, the air in the first air chamber 11 and the second air chamber 12 are allowed not to be leaked out thereby attaining to the air locking effect.

Therefore, not only the air filling speed of the first air chamber 11 and the second air chamber 12 can be faster such that the time required for the air filling can be shortened, but also when one of the first air chamber 11 and the second air chamber 12 is broken, the another one is allowed not to influence and to maintain in an airtight state to continue providing the cushioning protection and maintain the shock absorbed cushioning capability because the first air chamber 11 and the air chamber 12 are independent to each other.

When the aforementioned two first inner films 1*a* is subject to the thrust of the inner air pressure of the first air chamber 11, the first inner films 1*a* might be attached closely onto the first outer film 2*a* or the middle film 2*c*, and might not be side-attached onto the first outer film 2*a* or the middle film 2*c* but become a double sheet cantilever type air enclosure and similarly, when the two second inner films 1*b* is subject to the thrust of the inner air pressure of the second air chamber 12, the second inner films 1*b* might be attached closely onto the middle film 2*c* or the first outer film 2*a*, and might not be side-attached onto the middle film 2*c* or the second outer film 2*b* but become a double sheet cantilever type air enclosure.

Figure 4:
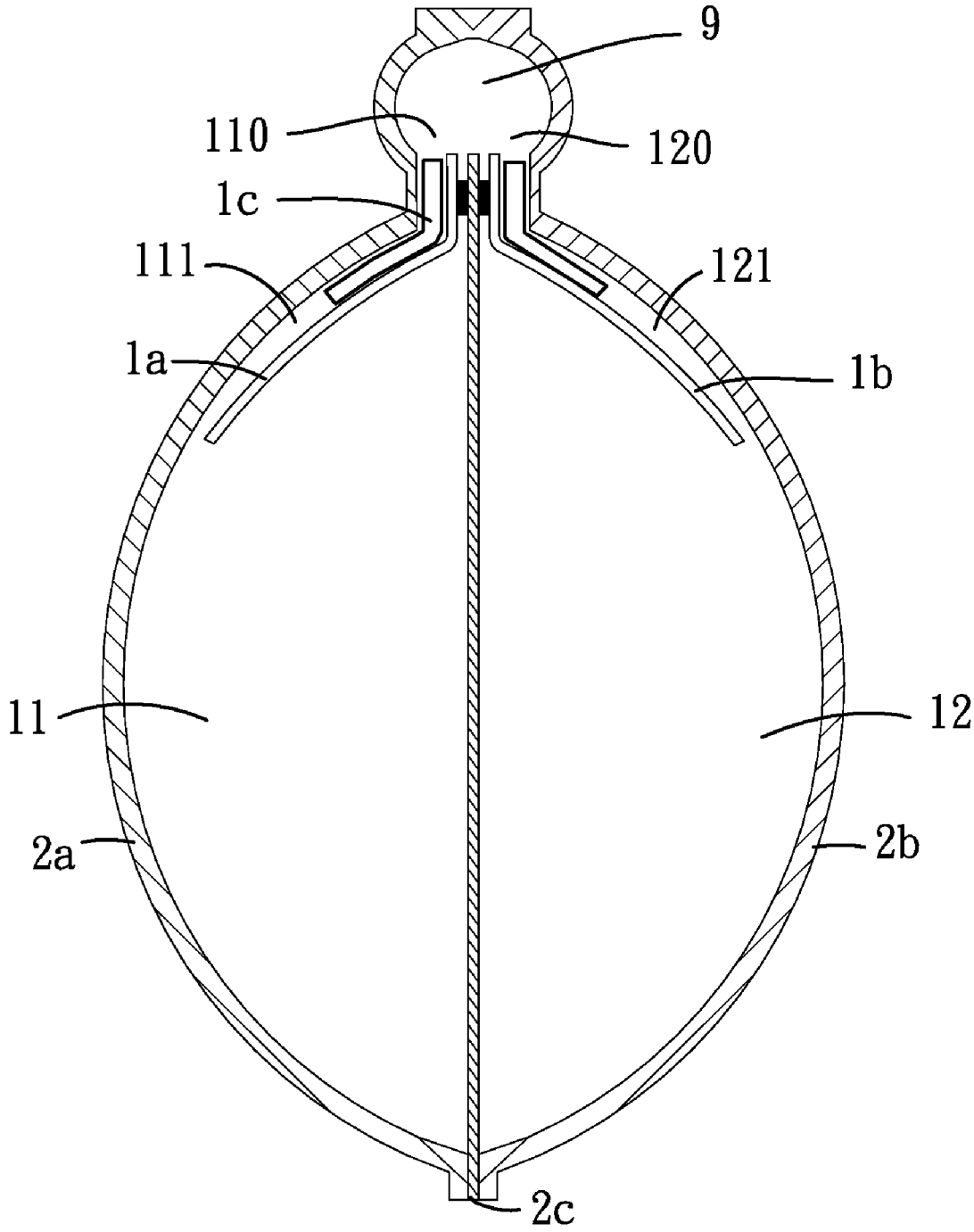
FIG. 4 is a cross sectional view, showing an air enclosure with independent double layer air chambers after air filling of a second preferred embodiment according to the present invention.
Figure 5:
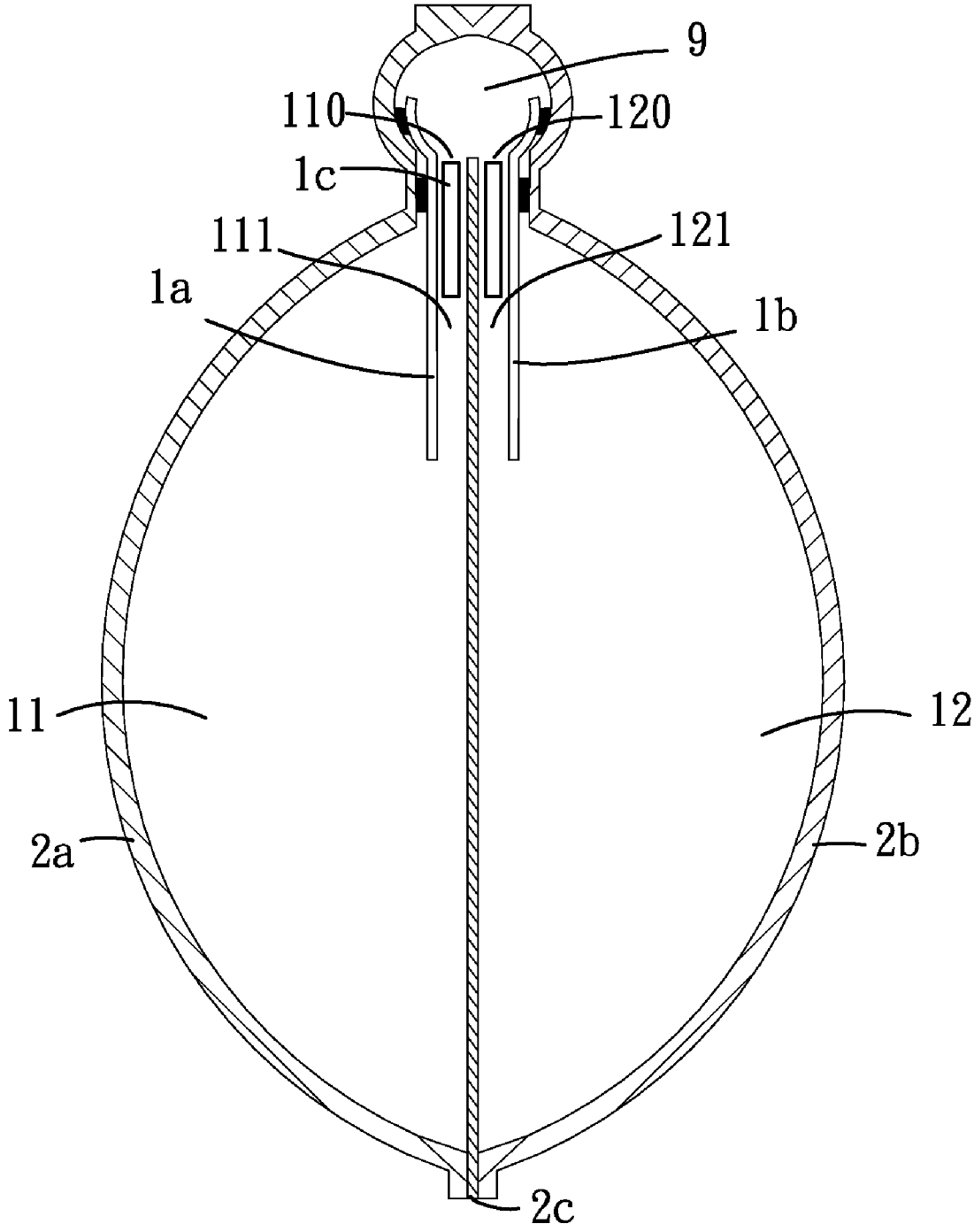
FIG. 5 is a cross sectional view, showing an air enclosure with independent double layer air chambers after air filling of a second preferred embodiment according to the present invention.

Please refer to FIGS. 4 and 5. FIG. 4 is a cross sectional view, showing an air enclosure with independent double layer air chambers after air filling of a second preferred embodiment according to the present invention. FIG. 5 is a cross sectional view, showing an air enclosure with independent double layer air chambers after air filling of a second preferred embodiment according to the present invention.

One first inner film 1*a* is disposed between the first outer film 2*a* and the middle 2*c*, and the upper side of the first inner film 1*a* is lined up with the upper side of the middle film 2*c* and similarly, one second inner film 1*b* is disposed between the middle film 2*c* and the second outer film 2*b*, and the upper side of the second inner film 1*b* is lined up with the upper side of the middle film 2*c*.

A heat resistant material 1*c* is spread on one face of the first inner film 1*a* to allow it not to be adhered to other films to form the first air inlet 110 and the first air passageway 111 connected to the first air inlet 110 used to communicate the air filling passageway 9 with the first air chamber 11 even by means of hot sealing, in which the first air passageway 111 is a hot-sealing curve type, the width of one end of the first air passageway 111 connected to the first air inlet 110 is larger than the width of another end thereof, and the air pressure in a curved portion of the first air passageway 111 is larger than the air pressure in two sides thereof to cause the air in the first air inlet 110 to enter easily and escape out uneasily; when the inner pressure in the first air chamber 11 increases, it thrusts the curved portion tightly to attain to the air locking effect. Moreover, the first air passageway 111 can also be a multiple dots type, double curve type or straight line type air progression route. Similarly, the second air inlet 120 and the second air passageway 121 having the same structure are also formed after one face of the second inner film 1*b* is spread with the heat resistant material 1*c* and used for communicating the air passageway 9 and the second air chamber 12.

The air entering the air filling entrance 9*a* expands the air filling passageway 9 to cause the first inner films 1*a* to be pulled outward to open each first air inlet 110 and in the meantime, cause the inner film 1*b* to be pulled outward to open each second air inlet 120, thereby the air in the air filling passageway 9 can be used to fill each first air chamber 11 and each second air chamber 12 with air to allow each first air chamber 11 and each second air chamber 12 to be filled with air and expanded. Thus, the inner air pressure of the first air chamber 11 presses the first inner films 1*a* to attach closely onto the first outer film 2*a* or the middle film 2*c* to cover the first air passageway 111 and hence, seal the first air chamber 11. Similarly, the inner air pressure of the second air chamber 12 presses the second inner films 1*b* to attach closely onto the middle film 2*c* or the second outer film 2*b* to cover the second air passageway 121 and hence, seal the second air chamber 12. Whereby, the air in the first air chamber 11 and the second air chamber 12 are allowed not to be leaked out to attain to the air locking effect.

Figure 6:
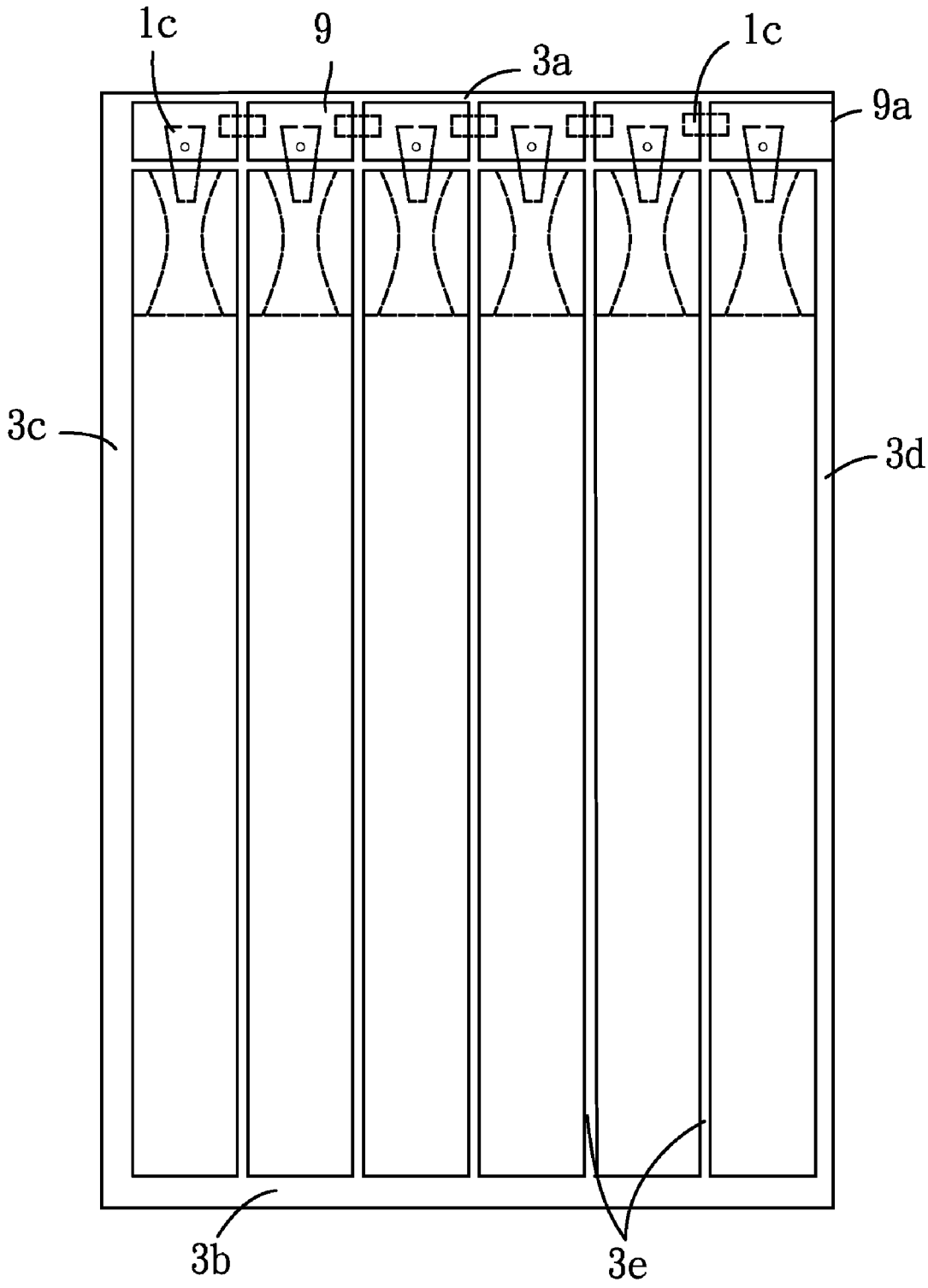
FIG. 6 is a plane view, showing an air enclosure with independent double layer air chambers before air filling of a third preferred embodiment according to the present invention.
Figure 7:
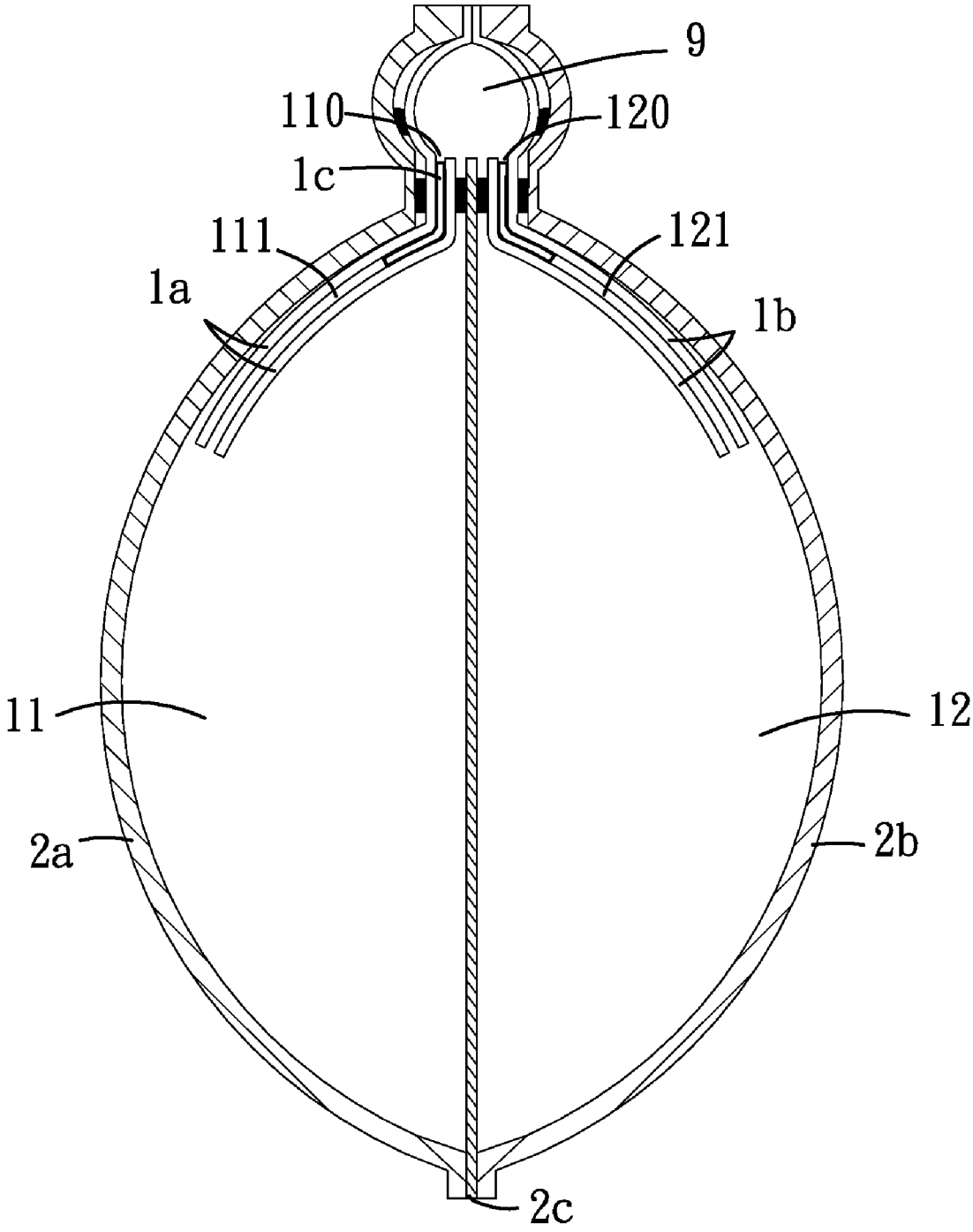
FIG. 7 is a cross sectional view, showing an air enclosure with independent double layer air chambers after air filling of a third preferred embodiment according to the present invention.
Figure 8:
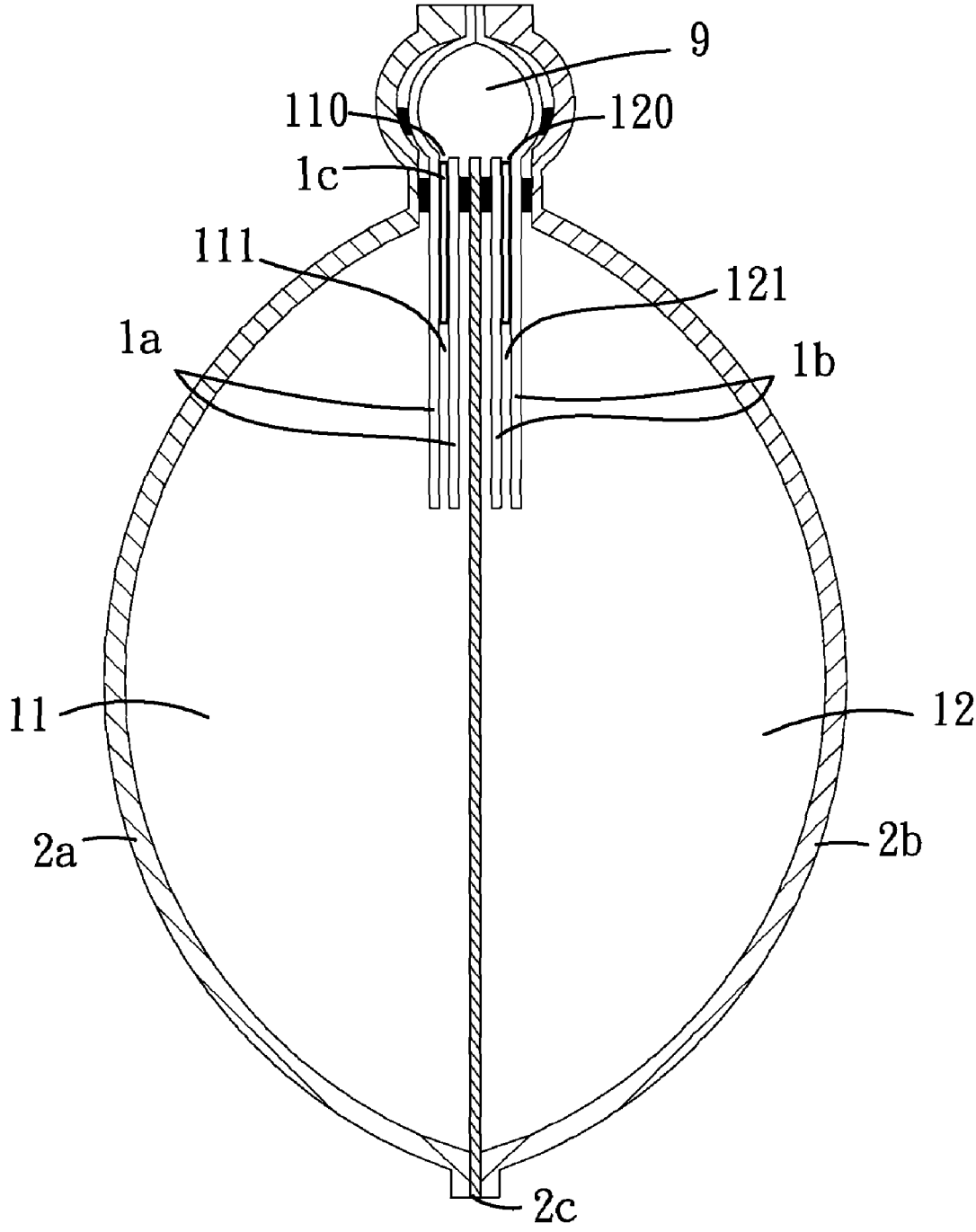
FIG. 8 is a cross sectional view, showing an air enclosure with independent double layer air chambers after air filling of a third preferred embodiment according to the present invention.

According to the structure disclosed by the present invention, a heat resistant material 1*c* is spread on one face of the first inner film 1*a* close to the first outer film 2*a*, the first inner film 1*a* is still not adhered to the first outer film 2*a* to form the first air inlet 110 even by means of hot sealing, and the inner air pressure in the first air chamber 11 thrusts the first inner film 1*a* to attach closely onto the first outer film 2*a* to cover the first air passageway 111 to seal the first air chamber 11 and similarly, a heat resistant material 1*c* is spread on one face of the first inner film 1*a* close to the middle film 2*c*, the first inner film 1*a* is still not adhered to the middle film 2*c* to form the first air inlet 110 even by means of hot sealing, and the inner air pressure in the first air chamber 11 thrusts the first inner film 1*a* to attach closely onto the middle film 2*c* to cover the first air passageway 111 to seal the first air chamber 11 please refer to FIGS. 6, 7 and 8. FIG. 6 is a plane view, showing an air enclosure with independent double layer air chambers before air filling of a third preferred embodiment according to the present invention. FIG. 7 is a cross sectional view, showing an air enclosure with independent double layer air chambers after air filling of a third preferred embodiment according to the present invention. FIG. 8 is a cross sectional view, showing an air enclosure with independent double layer air chambers after air filling of a third preferred embodiment according to the present invention;

Two first inner films 1*a* are disposed between the first outer film 2*a* and the middle film 2*c*, and the upper side of the first inner film 1*a* positioned closer to the first outer film 2*a* is lined up with the upper side of the first outer film 2*a* and similarly, two second inner films 1*b* are disposed between the middle film 2*c* and the second outer film 2*b*, and the upper side of the second inner film 1*b* positioned closer to the second outer film 2*b* is lined up with the upper side of the second outer film 2*b*. The first outer film 2*a*, the first inner film 1*a*, the second outer film 2*b* and the second inner film 1*b* are adhered by means of hot sealing to allow an air filling passageway 9 to be formed between the first inner film 1*a* and the second inner film 1*b* and positioned on one common end of the first outer film 2*a* and the second outer film 2*b*.

A heat resistant material 1*c* is spread sequentially and separately between the two first inner films 1*a*. The two first inner films 1*a* are still not adhered to each other to form an air inlet 110 and a first air passageway 111 connected to the first air inlet 110 used for communicating the air filling passageway 9 with the first air chamber after hot sealing is processed. Here, the first air passageway 111 is a hot-sealing curve type and the width of one end of the first air passageway 111 connected to the first air inlet 110 is larger than the width of another end thereof. Furthermore, the first air passageway 111 can also be a multiple dots type, double curve type or straight line type air flowing route. Besides, a second air inlet 120 and a second air passageway 121 having the same structures are formed between the two second inner films 1*b* and used for communicating the air filling passageway 9 with the second air chamber 12.

Figure 9:
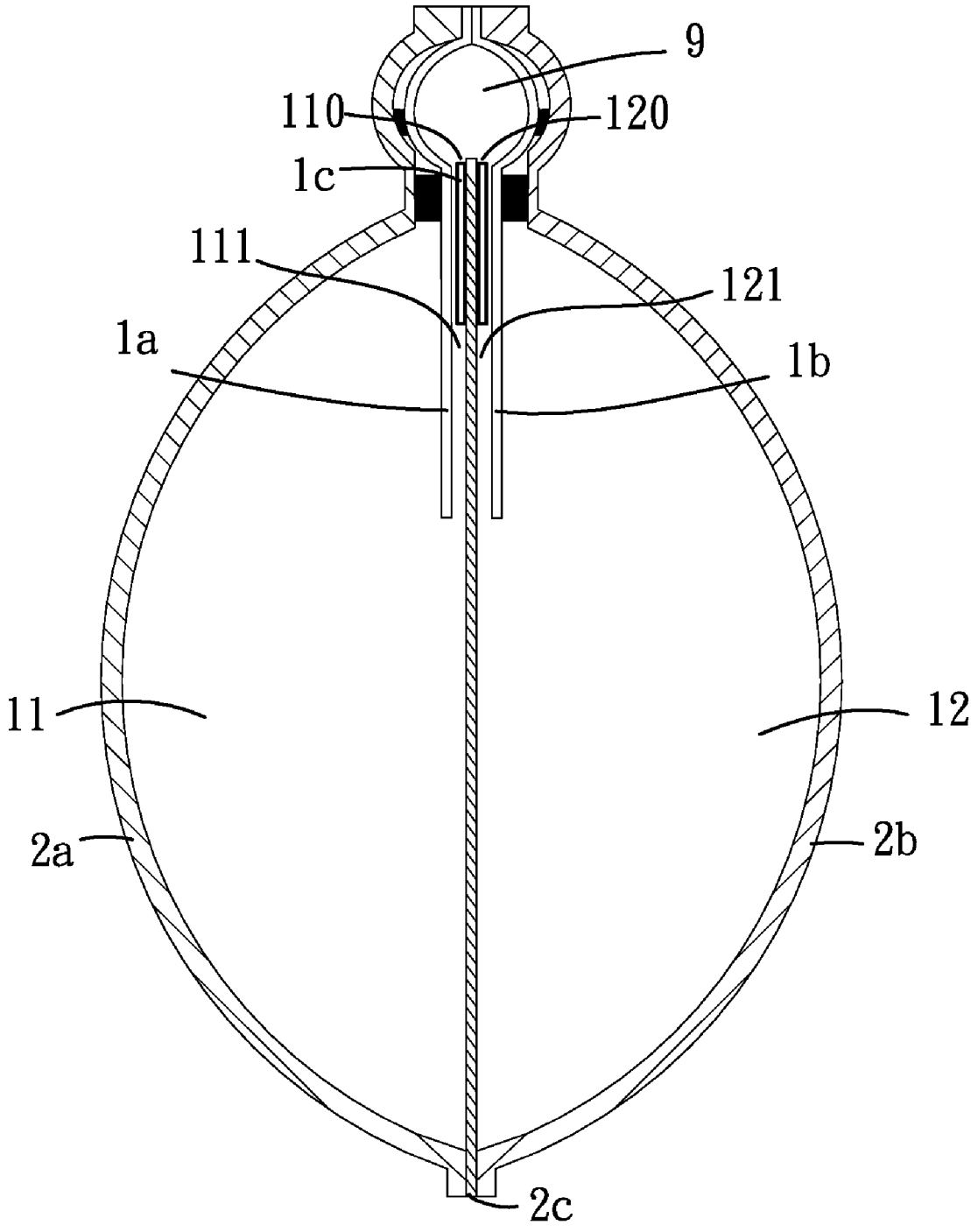
FIG. 9 is a cross sectional view, showing an air enclosure with independent double layer air chambers after air filling of a fourth preferred embodiment according to the present invention.

From the structure mentioned above, when the two first inner films 1*a* is subject to the thrust of the inner air pressure of the first air chamber 11, the first inner films 1*a* might be attached closely onto the first outer film 2*a* or the middle film 2*c*, and might not be side-attached onto the first outer film 2*a* or the middle film 2*c* but become a double sheet cantilever type air enclosure and similarly, when the two second inner films 1*b* is subject to the thrust of the inner air pressure of the second air chamber 12, the second inner films 1*b* might be attached closely onto the middle film 2*c* or the first outer film 2*a*, and might not be side-attached onto the middle film 2*c* or the second outer film 2*b* but become a double-sheet cantilever type air enclosure Please refer to FIG. 9. FIG. 9 is a cross sectional view, showing an air enclosure with independent double layer air chambers after air filling of a fourth preferred embodiment according to the present invention;

One first inner film 1*a* is disposed between the first outer film 2*a* and the middle 2*c*, and the upper side of the first inner film 1*a* is lined up with the upper side of the middle film 2*c* and similarly, one second inner film 1*b* is disposed between the middle film 2*c* and the second outer film 2*b*, and the upper side of the second inner film 1*b* is lined up with the upper side of the middle film 2*c*. The first outer film 2*a*, the first inner film 1*a*, the second outer film 2*b* and the second inner film 1*b* are adhered by means of hot sealing to allow an air filling passageway 9 to be formed between the first inner film 1*a* and the second inner film 1*b* and positioned on one common end of the first outer film 2*a* and the second outer film 2*b*.

A heat resistant material 1*c* is spread on one face of the first inner film 1*a*. The first inner film 1*a* is not adhered to other films to form a first air inlet 110 and a first air passageway 111 connected to the first air inlet 110 used for communicating the air filling passageway 9 with the first air chamber 11 even after hot sealing is processed. Here, the first air passageway 111 is a hot-sealing curve type and the width of one end of the first air passageway 111 connected to the first air inlet 110 is larger than the width of another end thereof. Furthermore, the first air passageway 111 can also be a multiple dots type, double curve type or straight line type air flowing route. Besides, a second air inlet 120 and a second air passageway 121 having the same structures are formed after one face of the second inner film 1*b* is spread with the heat resistant material 1*c* and used for communicating the air filling passageway 9 with the second air chamber 12.

Figure 10:
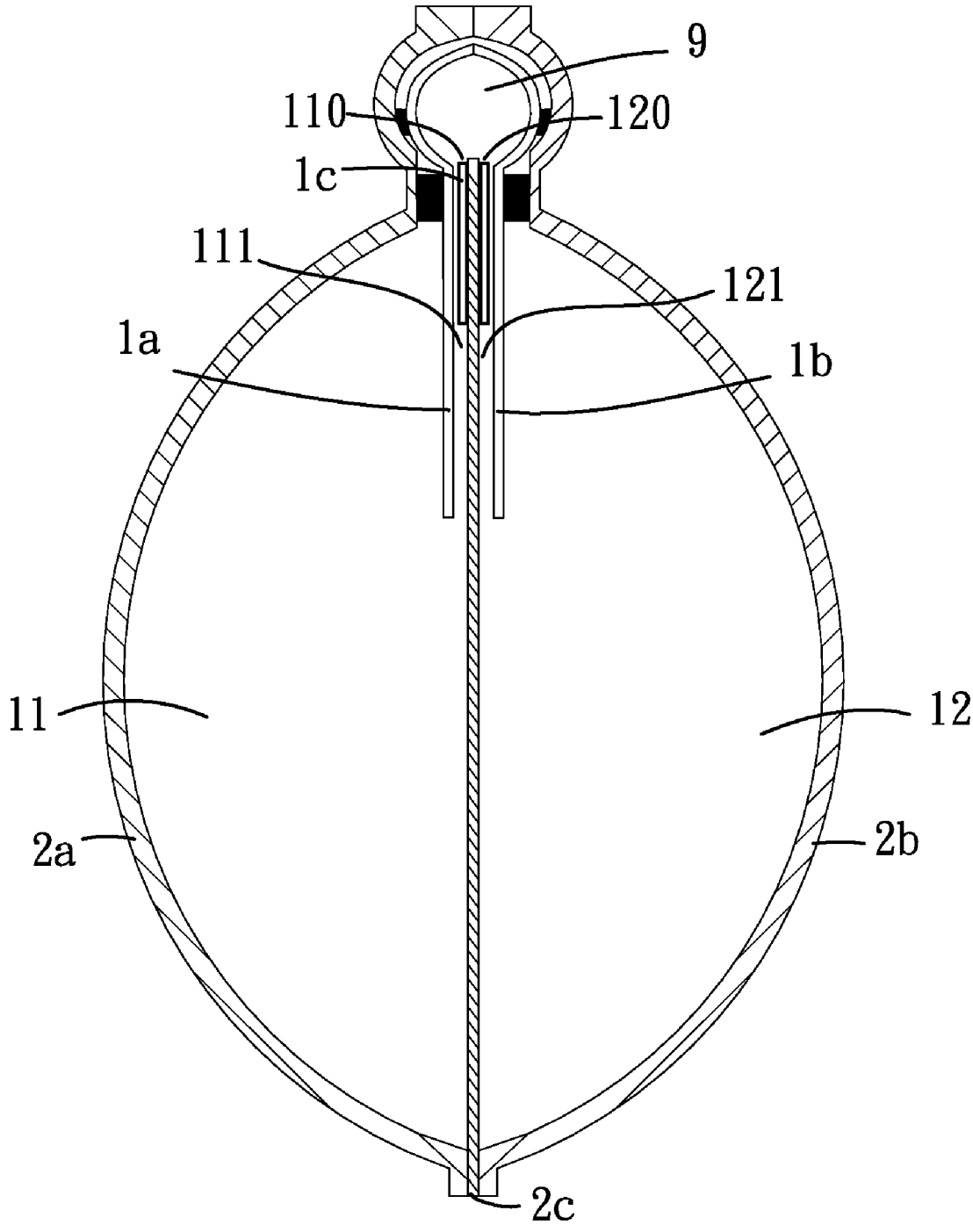
FIG. 10 is a cross sectional view, showing an air enclosure with independent double layer air chambers after air filling of a fifth preferred embodiment according to the present invention.

Please refer to FIG. 10. FIG. 10 is a cross sectional view, showing an air enclosure with independent double layer air chambers after air filling of a fifth preferred embodiment according to the present invention;

One first inner film 1*a* is disposed between the first outer film 2*a* and the middle 2*c* and one second inner film 1*b* is disposed between the middle film 2*c* and the second outer film 2*b*. The first outer film 2*a*, the first inner film 1*a*, the second outer film 2*b* and the second inner film 1*b* are adhered by means of hot sealing to allow an air filling passageway 9 to be formed between the first inner film 1*a* and the second inner film 1*b* and positioned on one common end of the first outer film 2*a* and the second outer film 2*b*.

Figure 11:
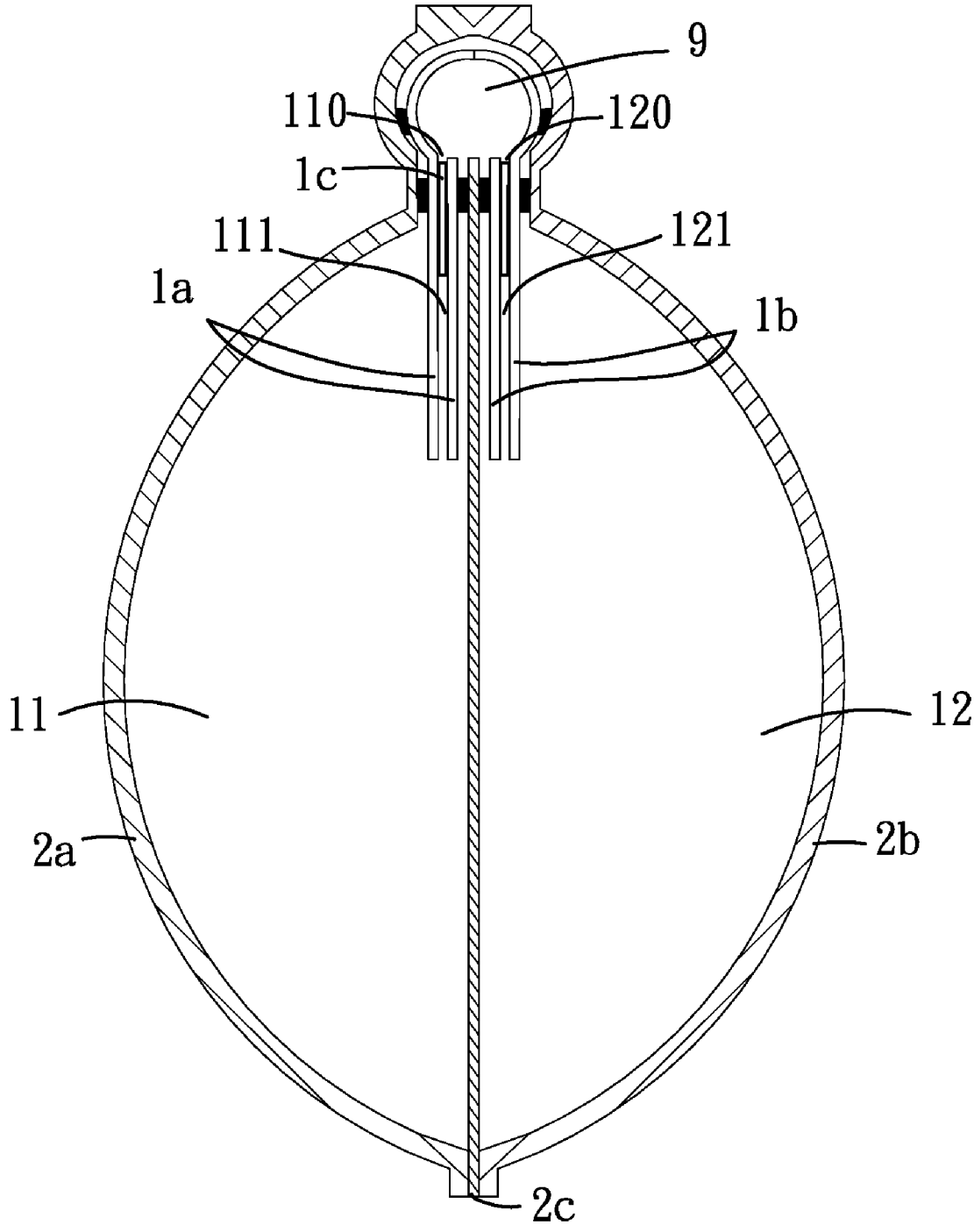
FIG. 11 is a cross sectional view, showing an air enclosure with independent double layer air chambers after air filling of a sixth preferred embodiment according to the present invention.
Figure 12:
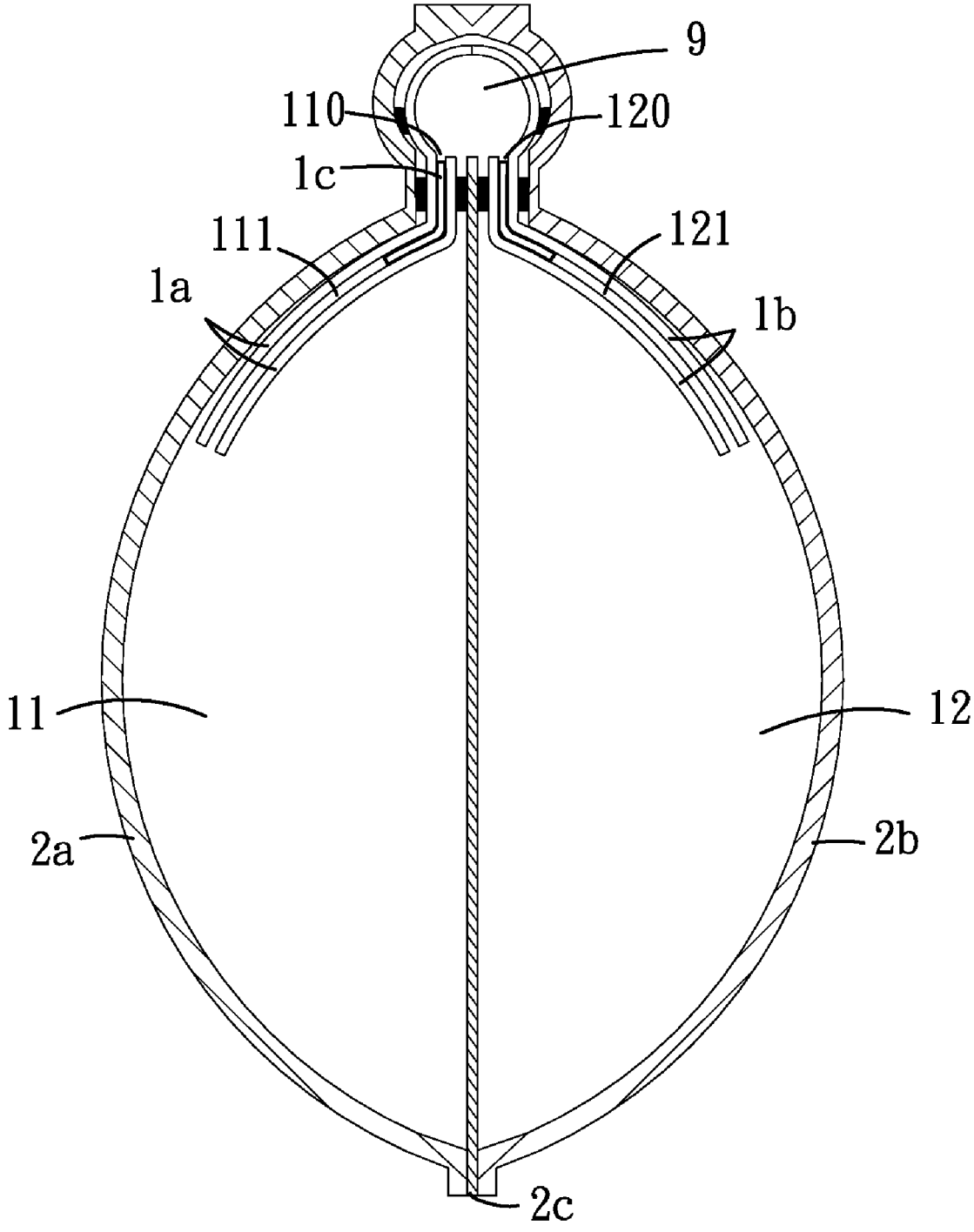
FIG. 12 is a cross sectional view, showing an air enclosure with independent double layer air chambers after air filling of a sixth preferred embodiment according to the present invention.

Please refer to FIGS. 11 and 12. FIG. 11 is a cross sectional view, showing an air enclosure with independent double layer air chambers after air filling of a sixth preferred embodiment according to the present invention. FIG. 12 is a cross sectional view, showing an air enclosure with independent double layer air chambers after air filling of a sixth preferred embodiment according to the present invention;

Two first inner films 1*a* are disposed between the first outer film 2*a* and the middle 2*c* and two second inner films 1*b* are disposed between the middle film 2*c* and the second outer film 2*b*. The first outer film 2*a*, the second outer film 2*b*, the first inner film 1*a* close to the first outer film 2*a* and the second inner film 1*b* close to the second outer film 2*b* are adhered by means of hot sealing to allow an air filling passageway 9 to be formed between the first inner film 1*a* and the second inner film 1*b* and positioned on one common end of the first outer film 2*a* and the second outer film 2*b*.

A heat resistant material 1*c* is spread sequentially and separately between the two first inner films 1*a*. The two first inner films 1*a* are still not adhered to each other to form an air inlet 110 and a first air passageway 111 connected to the first air inlet 110 used for communicating the air filling passageway 9 with the first air chamber after hot sealing is processed. Here, the first air passageway 111 is a hot-sealing curve type and the width of one end of the first air passageway 111 connected to the first air inlet 110 is larger than the width of another end thereof. Furthermore, the first air passageway 111 can also be a multiple dots type, double curve type or straight line type air flowing route. Besides, a second air inlet 120 and a second air passageway 121 having the same structures are formed between the two second inner films 1*b* and used for communicating the air filling passageway 9 with the second air chamber 12.

From the structure mentioned, when the two first inner films 1*a* is subject to the thrust of the inner air pressure of the first air chamber 11, the first inner films 1*a* might be attached closely onto the first outer film 2*a* or the middle film 2*c*, and might not be side-attached onto the first outer film 2*a* or the middle film 2*c* but become a double sheet cantilever type air enclosure and similarly, when the two second inner films 1*b* is subject to the thrust of the inner air pressure of the second air chamber 12, the second inner films 1*b* might be attached closely onto the middle film 2*c* or the first outer film 2*a*, and might not be side-attached onto the middle film 2*c* or the second outer film 2*b* but become a double-sheet cantilever type air enclosure.

Figure 13:
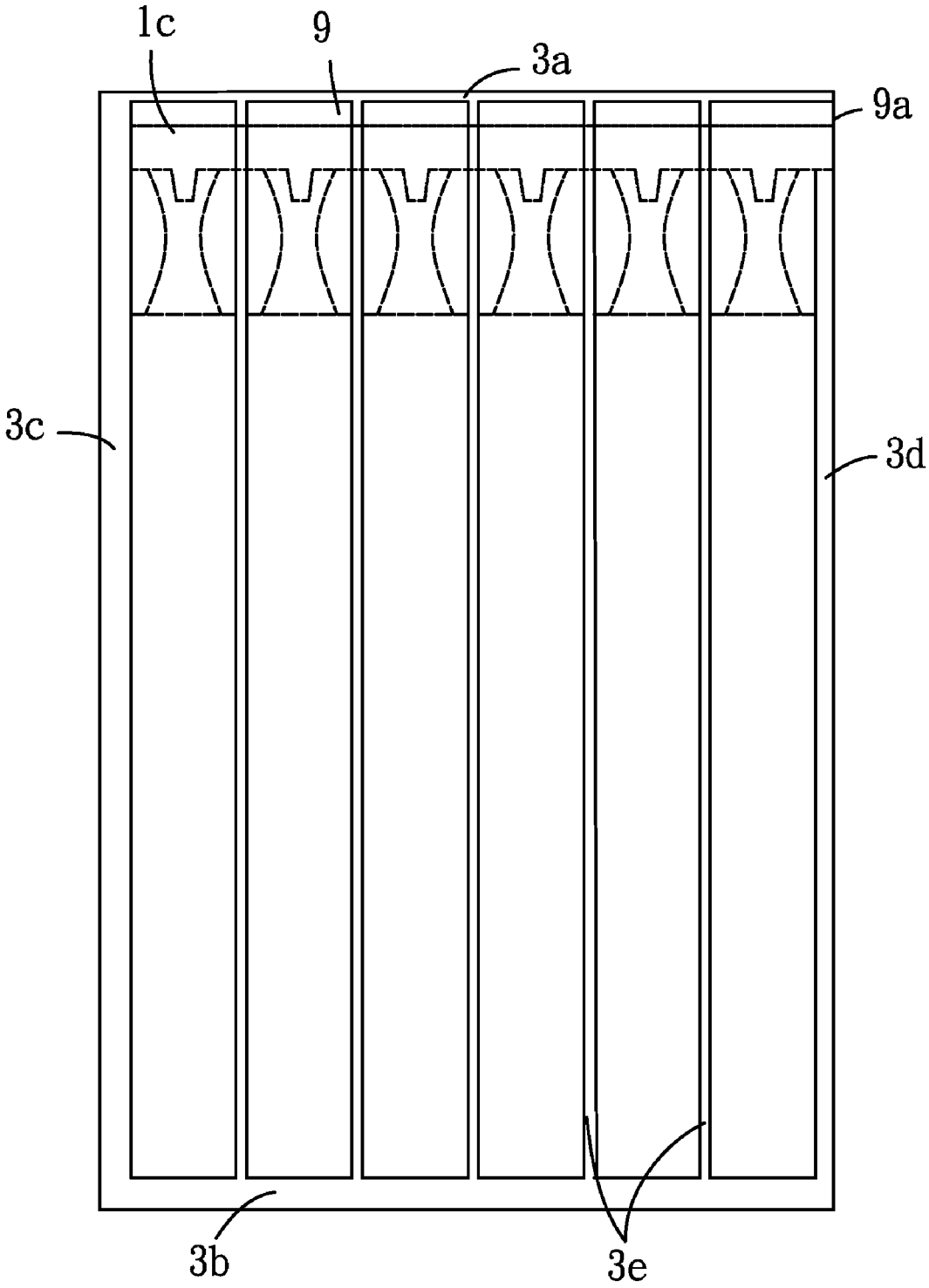
FIG. 13 is a plane view, showing an air enclosure with independent double layer air chambers before air filling of a seventh preferred embodiment according to the present invention.
Figure 14:
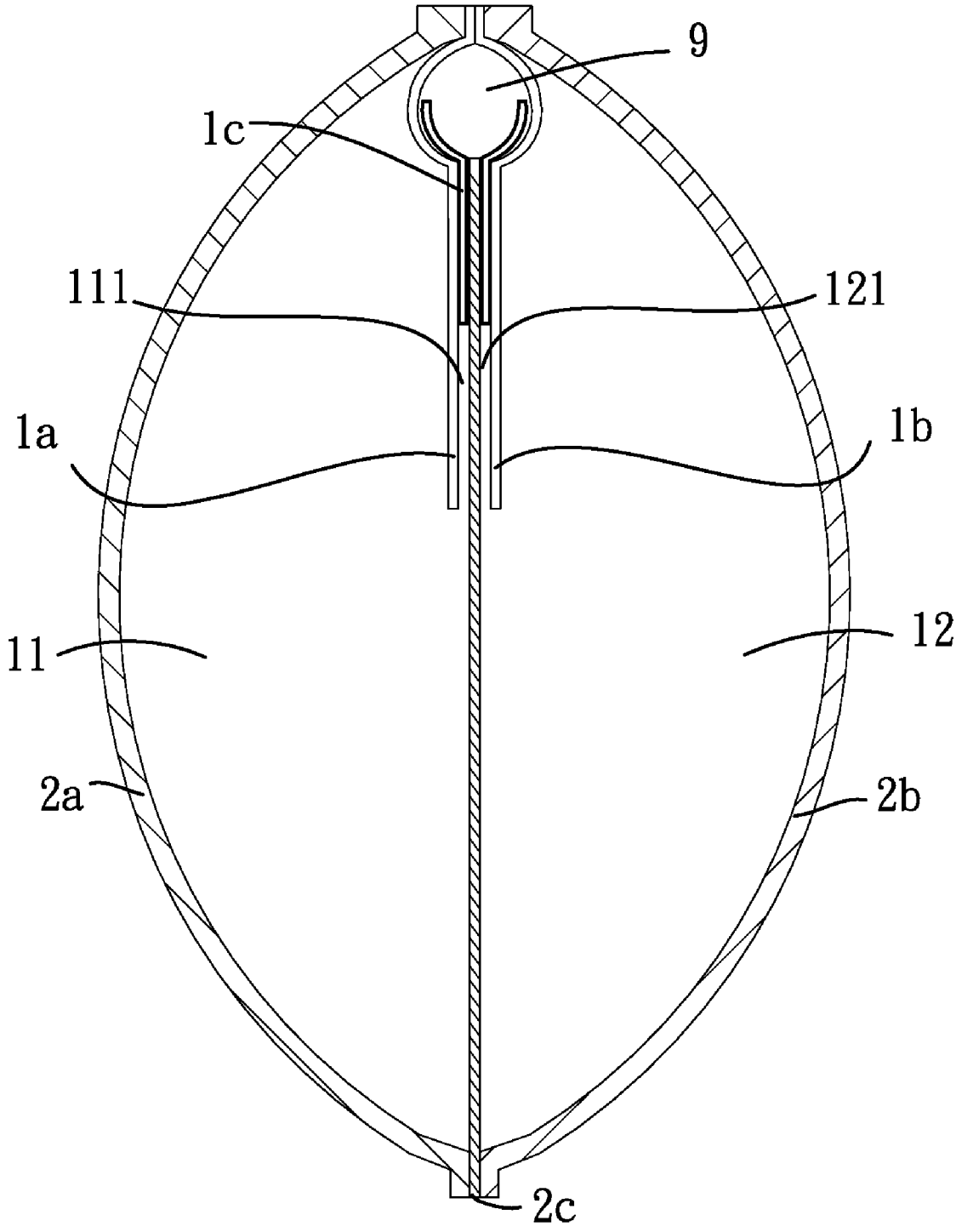
FIG. 14 is a cross sectional view, showing an air enclosure with independent double layer air chambers after air filling of a seventh preferred embodiment according to the present invention.
Figure 15:
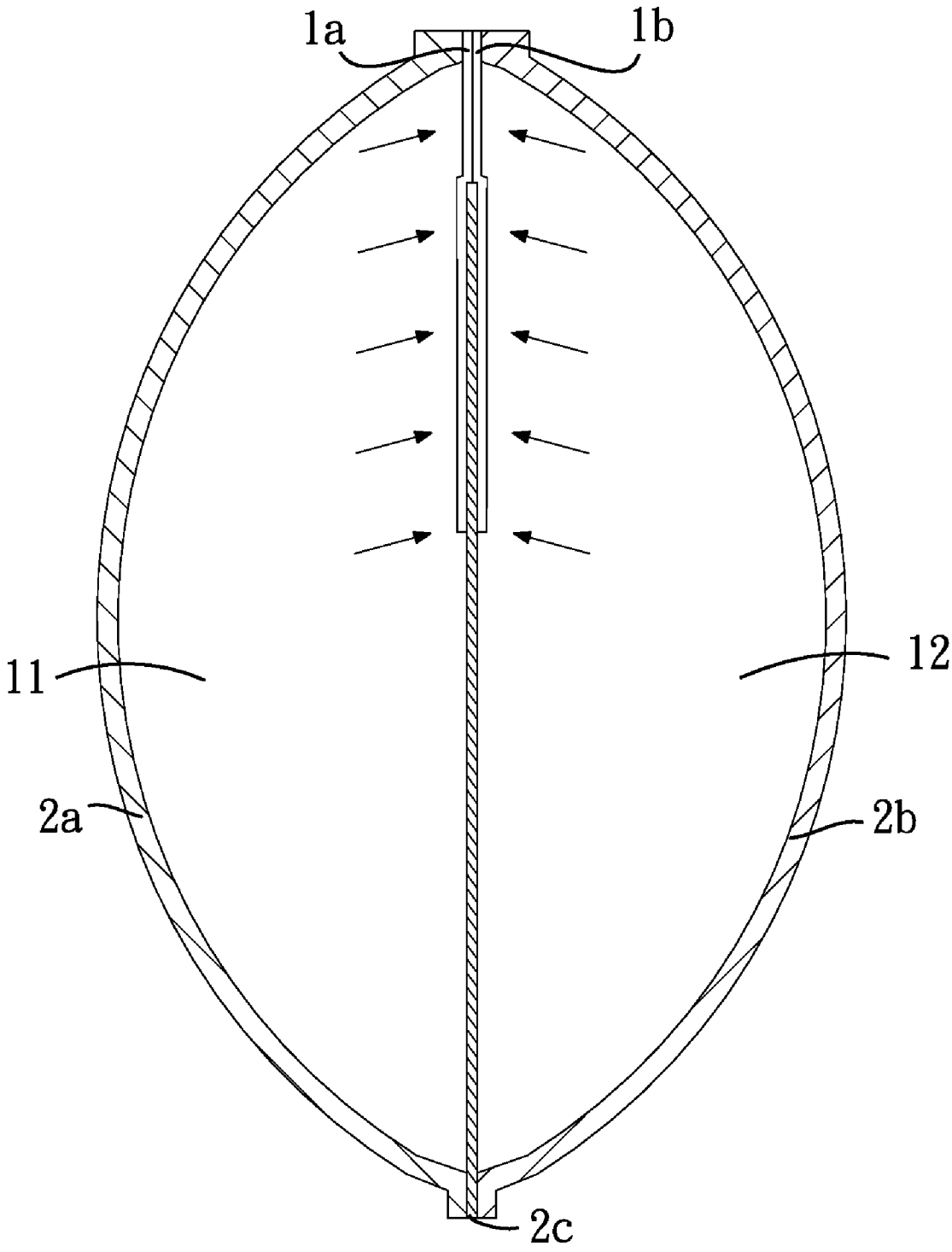
FIG. 15 is a cross sectional view, showing an air enclosure with independent double layer air chambers after air filling of a seventh preferred embodiment according to the present invention.

Please refer to FIGS. 13, 14 and 15. FIG. 13 is a plane view, showing an air enclosure with independent double layer air chambers before air filling of a seventh preferred embodiment according to the present invention. FIG. 14 is a cross sectional view, showing an air enclosure with independent double layer air chambers after air filling of a seventh preferred embodiment according to the present invention. FIG. 15 is a cross sectional view, showing an air enclosure with independent double layer air chambers after air filling of a seventh preferred embodiment according to the present invention.

One first inner film 1*a* is disposed between the first outer film 2*a* and the upper side of the first inner film 1*a* is lined up with the upper side of the first outer film 2*a* and similarly, the middle 2*c* and one second inner film 1*b* is disposed between the middle film 2*c* and the second outer film 2*b* and the upper side of the upper side of the second inner film 1*b* is lined up with the upper side of the second outer film. The upper sides of first outer film 2*a*, the first inner film 1*a*, the second outer film 2*b* and the second inner film 1*b* are adhered together by means of hot sealing and the middle portions of the first inner film 1*a* and the second inner film 1*b* are also adhered together to allow an air filling passageway 9 to be formed between the first inner film 1*a* and the second inner film 1*b* and positioned on one common end of the first outer film 2*a* and the second outer film 2*b*. One first inner film 1*a* is disposed between the first outer film 2*a* and the middle 2*c* and one second inner film 1*b* is disposed between the middle film 2*c* and the second outer film 2*b*. The first outer film 2*a*, the first inner film 1*a*, the second outer film 2*b* and the second inner film 1*b* are adhered by means of hot sealing to allow an air filling passageway 9 to be formed between the first inner film 1*a* and the second inner film 1*b* and positioned on one common end of the first outer film 2*a* and the second outer film 2*b*. In such kind structure, two first inner films 1*a* can also be disposed between the first outer film 2*a* and the middle film 2*c*, and the upper side of the first inner film 1*a* positioned closer to the first outer film 2*a* is lined up with the upper side of the first outer film 2*a* and similarly, two second inner films 1*b* can also be disposed between the middle film 2*c* and the second outer film 2*b*, and the upper side of the second inner film 1*b* positioned closer to the second outer film 2*b* is lined up with the upper side of the second outer film 2*b*.

A heat resistant material 1*c* is spread on one face of the first inner film 1*a*. The first inner film 1*a* is not adhered to other films to form a first air inlet 110 and a first air passageway 111 connected to the first air inlet 110 used for communicating the air filling passageway 9 with the first air chamber 11 even after hot sealing is processed. Here, the first air passageway 111 is a hot-sealing curve type and the width of one end of the first air passageway 111 connected to the first air inlet 110 is larger than the width of another end thereof. Furthermore, the first air passageway 111 can also be a multiple dots type, double curve type or straight line type air flowing route. Besides, a second air inlet 120 and a second air passageway 121 having the same structures are formed after one face of the second inner film 1*b* is spread with the heat resistant material 1*c* and used for communicating the air filling passageway 9 with the second air chamber 12.

The air entering the air filling entrance 9*a* expands the air filling passageway 9 to cause the first inner films 1*a* to be pulled outward to open each first air inlet 110 and in the meantime, cause the inner film 1*b* to be pulled outward to open each second air inlet 120, thereby the air in the air filling passageway 9 can be used to fill the first air chamber 11 and the second air chamber 12 with air to allow the first air chamber 11 and the second air chamber 12 to be filled with air and expanded. Thus, the inner air pressure of the first air chamber 11 presses the first inner films 1*a* to attach closely onto the first outer film 2*a* or the middle film 2*c* to cover the first air passageway 111 and hence, seal the first air chamber 11. Similarly, the inner air pressure of the second air chamber 12 presses the second inner films 1*b* to attach closely onto the middle film 2*c* or the second outer film 2*b* to cover the second air passageway 121 and hence, seal the second air chamber 12. Moreover, the inner air pressure in the first air chamber 11 and the second air chamber 12 might also simultaneously press the first inner film 1*a* and the second inner film 1*b* to cause the air filling passageway 9 to be thrust to seal. Whereby, the air in the first air chamber 11 and the second air chamber 12 are allowed not to be leaked out to attain to the air locking effect.

According to the structure disclosed by the present invention, the air filling passageway 9 can be connected to one first air inlet 110 or connected with the plurality of first air inlets 110; each first air chamber 11 can be connected to one first air passageway 111 or connected with the plurality of first air passageways 111, and each two first air chambers 11 can be communicated with each other and can further share one first air passageway 111 or the plurality of first air passageways 111. furthermore, the air filling passageway 9 can be connected to one second air inlet 120 or connected with the plurality of second air inlets 120; each second air chamber 12 can be connected to one second air passageway 121 or connected with the plurality of second air passageways 121, and each two second air chambers 12 can be communicated with each other and can further share one second air passageway 121 or the plurality of second air passageways 121.

Figure 16:
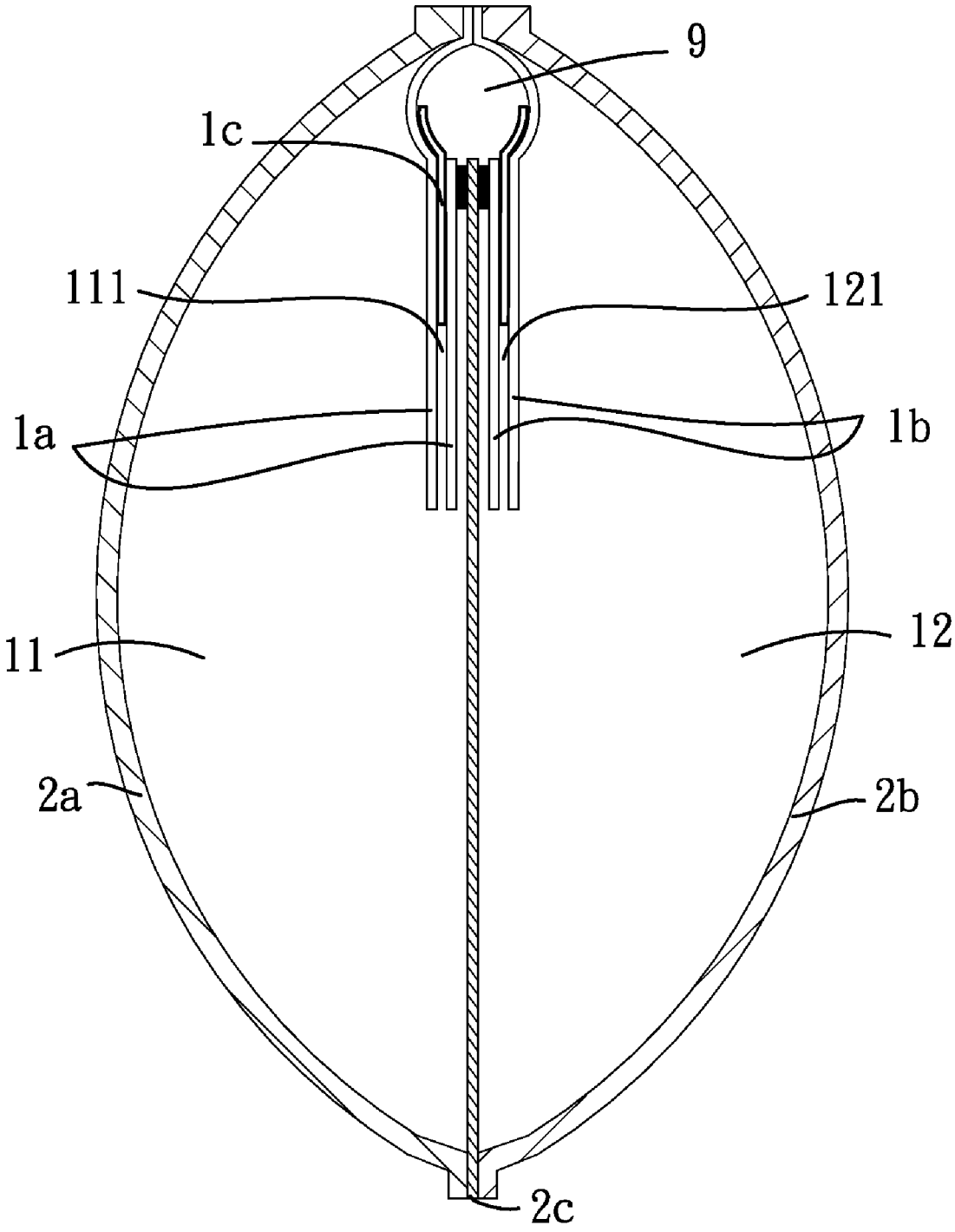
FIG. 16 is a cross sectional view, showing an air enclosure with independent double layer air chambers after air filling of a eighth preferred embodiment according to the present invention.

Please refer to FIG. 16. FIG. 16 is a cross sectional view, showing an air enclosure with independent double layer air chambers after air filling of a eighth preferred embodiment according to the present invention;

Two first inner films 1*a* are disposed between the first outer film 2*a* and the middle film 2*c*, and the upper side of the first inner film 1*a* positioned closer to the first outer film 2*a* is lined up with the upper side of the first outer film 2*a* and similarly, two second inner films 1*b* are disposed between the middle film 2*c* and the second outer film 2*b*, and the upper side of the second inner film 1*b* positioned closer to the second outer film 2*b* is lined up with the upper side of the second outer film 2*b*. The first outer film 2*a*, the first inner film 1*a*, the second outer film 2*b* and the second inner film 1*b* are adhered by means of hot sealing to allow an air filling passageway 9 to be formed between the first inner film 1*a* and the second inner film 1*b* and positioned on one common end of the first outer film 2*a* and the second outer film 2*b*.

A heat resistant material 1*c* is spread sequentially and separately between the two first inner films 1*a*. The two first inner films 1*a* are still not adhered to each other to form an air inlet 110 and a first air passageway 111 connected to the first air inlet 110 used for communicating the air filling passageway 9 and the first air chamber 11 after hot sealing is processed. Here, the first air passageway 111 is a hot-sealing curve type and the width of one end of the first air passageway 111 connected to the first air inlet 110 is larger than the width of another end thereof. Furthermore, the first air passageway 111 can also be a multiple dots type, double curve type or straight line type air flowing route. Besides, a second air inlet 120 and a second air passageway 121 having the same structures are formed between the two second inner films 1*b* and used for communicating the air filling passageway 9 with the second air chamber 12.

The air entering the air filling entrance 9*a* expands the air filling passageway 9 to cause the two first inner films 1*a* to be pulled outward to open the first air inlet 110 and in the meantime, cause the two second inner films 1*b* to be pulled outward to open the second air inlet 120, thereby the air in the air filling passageway 9 can be used to fill the first air chamber 11 and the second air chamber 12 with air to allow each first air chamber 11 and each second air chamber 12 to be filled with air and expanded. Thus, the inner air pressure of the first air chamber 11 presses the two first inner films 1*a* to attach closely onto the first outer film 2*a* or the middle film 2*c* to cover the first air passageway 111 and hence, seal the first air chamber 11. Similarly, the inner air pressure of the second air chamber 12 presses the two second inner films 1*b* to attach closely onto the middle film 2*c* or the second outer film 2*b* to cover the second air passageway 121 and hence, seal the second air chamber 12. Whereby, the air in the first air chamber and the second air chamber 12 are allowed not to be leaked out to attain to the double air locking effect.

From the structure mentioned, when the two first inner films 1*a* is subject to the thrust of the inner air pressure of the first air chamber 11, the first inner films 1*a* might be attached closely onto the first outer film 2*a* or the middle film 2*c*, and might not be side-attached onto the first outer film 2*a* or the middle film 2*c* but become a double sheet cantilever type air enclosure and similarly, when the two second inner films 1*b* is subject to the thrust of the inner air pressure of the second air chamber 12, the second inner films 1*b* might be attached closely onto the middle film 2*c* or the first outer film 2*a*, and might not be side-attached onto the middle film 2*c* or the second outer film 2*b* but become a double-sheet cantilever type air enclosure.

Figure 17:
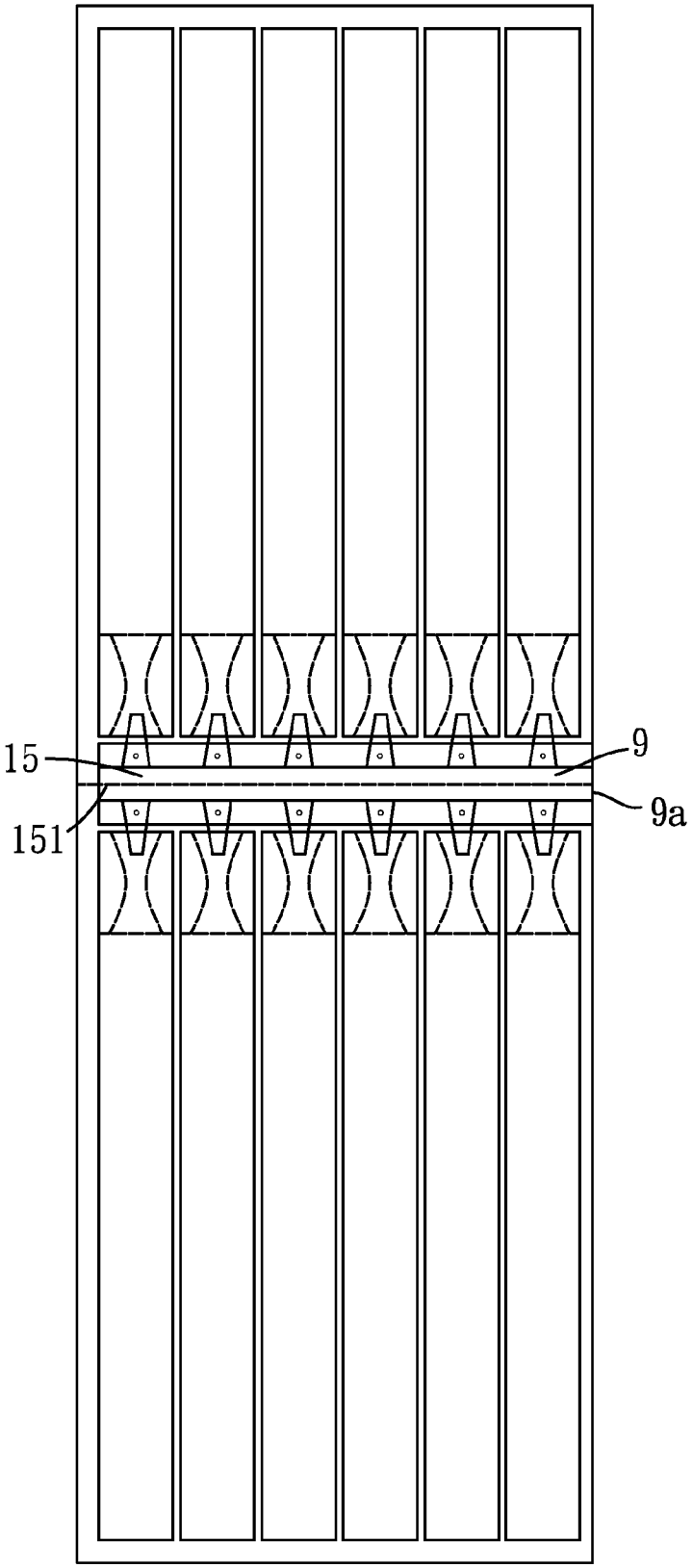
FIG. 17 is a plane view, showing an air enclosure with independent double layer air chambers before air filling of a ninth preferred embodiment according to the present invention.
Figure 18:
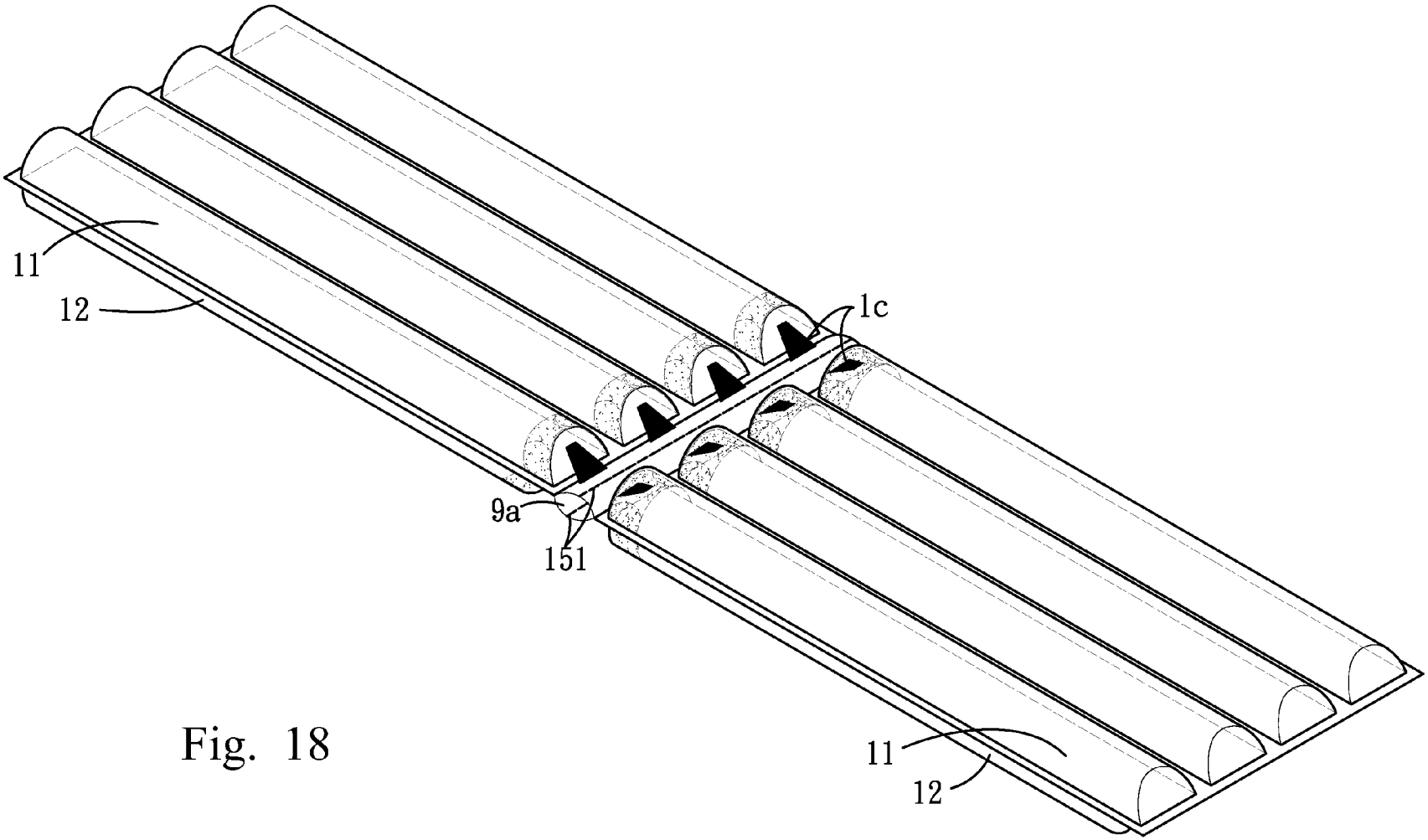
FIG. 18 is a cross sectional view, showing an air enclosure with independent double layer air chambers after air filling of a ninth preferred embodiment according to the present invention.

Please refer to FIGS. 17 and 18. FIG. 17 is a plane view, showing an air enclosure with independent double layer air chambers before air filling of a ninth preferred embodiment according to the present invention. FIG. 18 is a cross sectional view, showing an air enclosure with independent double layer air chambers after air filling of a ninth preferred embodiment according to the present invention.

An air filling passageway 9 is positioned at a place in the middle of an inner films 2*a* and an second outer film 2*b*, and a plurality of first air chambers 11 and a plurality of second air chambers 12 are formed at two ends of the air filling passageway 9. When air is filled, the air in the air filling passageway 9 is filled into the first air chambers 11 and the second air chambers 12 at the same time to attain to the air filling time reduction purpose.

Furthermore, a cutting zone 15 is disposed on the air filling passageway 9 to allow the air chambers at the both ends of the air filling passageway 9 to be separated by cutting along a cutting line 151 on the cutting zone 15 after air is filled; this allows the product output of the air enclosures to be double.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents

What is claimed is:

1. An air enclosure with independent double layer air chambers, comprising:

a first outer film;

a second outer film, folded with the first outer film;

at least one first middle film, disposed between the first outer film and the second outer film, a length of the first middle film being shorter than the first outer film and the second outer film, one side of the first middle film being lined up with one common side of the first outer film and the second outer film;

at least one first inner film, positioned between the first outer film and the first middle film;

at least one second inner film, positioned between the first middle film and the second outer film;

an air filling passageway, being an air passable space defined between two hot sealing portions, the first outer film and the second outer film being adhered to each other along the two hot sealing portions;

a first hot sealing point and a second hot sealing point positioned between the two hot sealing portions, the first hot sealing point lying between the first outer film and the first inner film which are adhered to each other at the first hot sealing point, the second hot sealing point lying between the second outer film and the second inner film which are adhered to each other at the second hot sealing point;

a plurality of first air chambers, positioned adjacent to the air filling passageway and being air storable spaces at one of two sides of the first middle film formed by adhering the first outer film to the first middle film by means of hot sealing;

at least one first air inlet, formed between the first outer film and the first middle film and used for communicating the air filling passageway with the first air chambers;

a plurality of second air chambers, positioned adjacent to the air filling passageway and being air storable spaces at another of the two sides of the first middle film formed by adhering the first middle film to the second outer film by means of hot sealing; and at least one second air inlet, formed between the first middle film and the second outer film and used for communicating the air filling passageway with the second air chambers, wherein air in the air filling passageway is filled into the first air chambers and the second air chambers to expand the first air chambers and the second air chambers individually via the first air inlets and the second air inlets, respectively.

2. The air enclosure according to claim 1, wherein a upper side of the first inner film is lined up with a upper side of the first middle film.

3. The air enclosure according to claim 1, wherein a heat resistant material is spread on one face of the first inner film, so that the first air inlet is formed by not adhering the one face of the first inner film to one of the first outer film and the first middle film by means of hot sealing.

4. The air enclosure according to claim 1, wherein the first air chambers comprise a first air passageway connected to the first air inlet.

5. The air enclosure according to claim 1, wherein a upper side of the second inner film is lined up with a upper side of the first middle film.

6. The air enclosure according to claim 1, wherein a heat resistant material is spread on one face of the second inner film, so that the second air inlet is formed by not adhering the one face of the second inner film to one of the second outer film and the first middle film by means of hot sealing.

7. The air enclosure according to claim 1, wherein the second air chambers comprise a second air passageway connected to the second air inlet.

8. The air enclosure according to claim 1, wherein the air filling passageway is positioned on one common end of the first outer film and the second outer film or a common middle positions of the first outer film and the second outer film.

9. The air enclosure according to claim 1, further comprising:

a cutting zone positioned on the air filling passageway;

a plurality of third air chambers adjacent to the air filling passageway and disposed on an opposite side of the air filling passageway from the plurality of first air chambers, the third air chambers being formed by adhering the first outer film to a second middle film by means of hot sealing; and a plurality of fourth air chambers adjacent to the air filling passageway and disposed on an opposite side of the air filling passageway from the plurality of second air chambers, the fourth air chambers being formed by adhering the second outer film to the second middle film by means of hot sealing, wherein the first and second air chambers are separable from the third and fourth air chambers by cutting along the cutting zone.

10. The air enclosure according to claim 1, wherein the first and second hot sealing points are positioned in the air filling passageway.

11. The air enclosure according to claim 1 comprising a third inner film positioned between the first inner film and the first middle film, wherein the length of the first inner film is longer than the length of the third inner film.

12. The air enclosure according to claim 1 comprising a fourth inner film positioned between the second inner film and the first middle film, wherein the length of the second inner film is longer than the length of the fourth inner film.

* * * * *